US007195512B2

(12) United States Patent
Jenkinson et al.

(10) Patent No.: US 7,195,512 B2
(45) Date of Patent: Mar. 27, 2007

(54) METHOD AND APPARATUS FOR CONTROL OF APPLIANCE COUPLER RETENTION AND WITHDRAWAL FORCES

(75) Inventors: Philip James Jenkinson, Epping (AU); Nicholas Jerome Reed, Mount Colah (AU); Philip Andrew Jones, Hornsby (AU); Dan Kao, Chatswood (AU)

(73) Assignee: ResMed, Limited, Bella Vista (AU)

( * ) Notice: Subject to any disclaimer, the term of this patent is extended or adjusted under 35 U.S.C. 154(b) by 0 days.

(21) Appl. No.: 10/602,532

(22) Filed: Jun. 24, 2003

(65) Prior Publication Data

US 2004/0063348 A1 Apr. 1, 2004

(30) Foreign Application Priority Data

Jun. 25, 2002 (AU) ..... PS3150

(51) Int. Cl.
*H01R 13/64* (2006.01)
*H01R 13/62* (2006.01)

(52) U.S. Cl. ..... 439/372; 439/923

(58) Field of Classification Search ..... 439/180, 439/157, 352, 369, 371–373, 502, 923
See application file for complete search history.

(56) References Cited

U.S. PATENT DOCUMENTS

| | | | | |
|---|---|---|---|---|
| 3,995,644 A | | 12/1976 | Parsons | 128/418 |
| 4,184,732 A | | 1/1980 | Hudson | 439/369 |
| 4,550,967 A | * | 11/1985 | Riches et al. | 439/332 |
| 4,690,476 A | | 9/1987 | Morgenrath | 439/502 |
| 5,017,149 A | | 5/1991 | Hatanaka | 439/157 |
| 5,022,866 A | | 6/1991 | Harting et al. | 439/372 |
| 5,713,752 A | * | 2/1998 | Leong et al. | 439/358 |
| 6,102,727 A | * | 8/2000 | Kawaguchi et al. | 439/372 |
| 6,106,321 A | | 8/2000 | Yoshida et al. | 439/352 |
| 6,325,647 B1 | | 12/2001 | May et al. | 439/157 |
| 6,655,971 B2 | * | 12/2003 | Maegawa | 439/157 |
| 2002/0019173 A1 | | 2/2002 | Oliphant et al. | 439/676 |

FOREIGN PATENT DOCUMENTS

DE 101 02 061 C1 6/2002

OTHER PUBLICATIONS

European Office Action of corresponding European Appln. No. 03 253 975.1 (Dec. 19, 2005).
Chinese Office Action of corresponding Chinese Appln. No. 03152464.8 (Aug. 18, 2006), together with English translation.

* cited by examiner

*Primary Examiner*—Javaid H. Nasri
(74) *Attorney, Agent, or Firm*—Nixon & Vanderhye P.C.

(57) ABSTRACT

A method and apparatus are provided for predetermining the withdrawal force required to disconnect an appliance coupler such as a plug and socket. The invention also relates to a method and apparatus for preventing disconnection of an appliance coupler such as a plug from a socket. Furthermore, the invention relates to method and apparatus for preventing inadvertent or unintentional disconnection of a plug from a socket for the supply of electrical power to a medical apparatus.

34 Claims, 31 Drawing Sheets

FIG. 8(b)
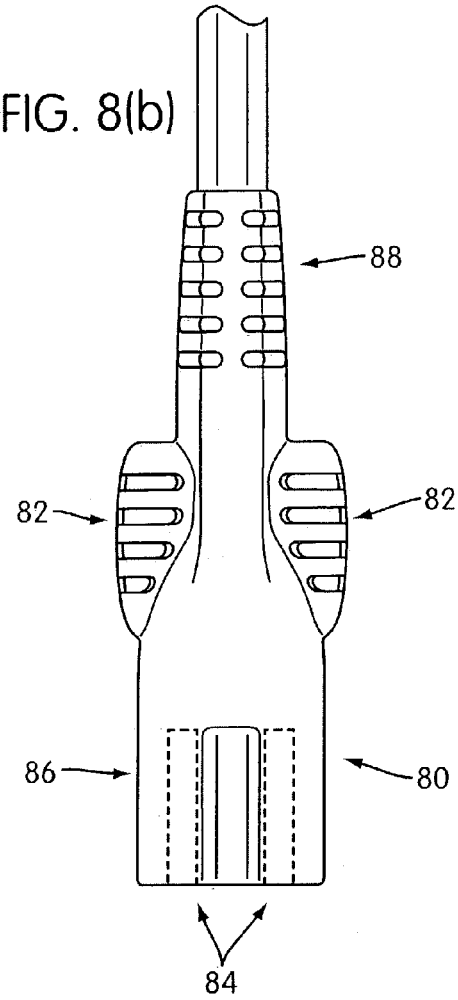
FIG. 8(c)
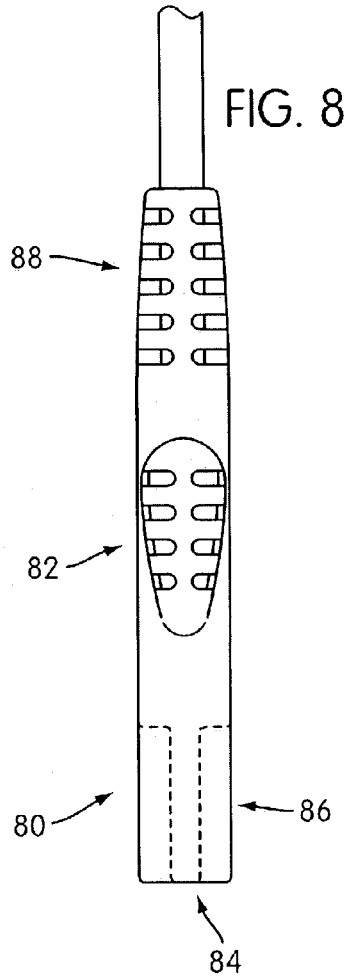
FIG. 8(a)
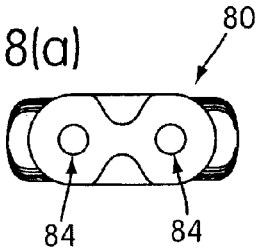
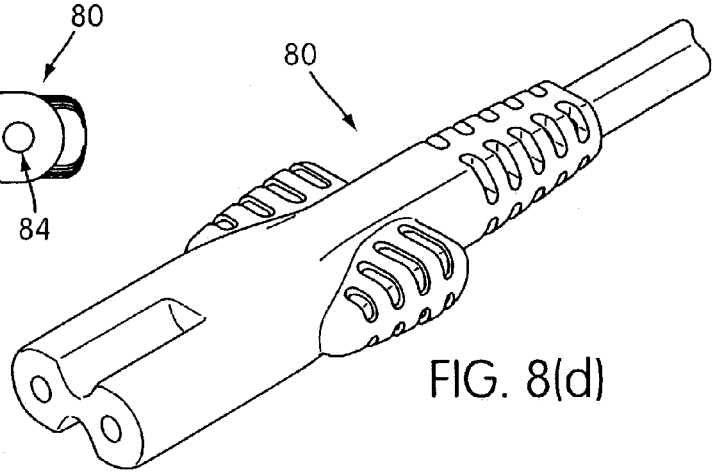
FIG. 8(d)

METHOD AND APPARATUS FOR CONTROL OF APPLIANCE COUPLER RETENTION AND WITHDRAWAL FORCES

CROSS REFERENCE TO RELATED APPLICATION

This application claims priority from Australian Application No. PS 3150, filed Jun. 25, 2002 the specification and drawings of which are incorporated herein by reference.

BACKGROUND OF THE INVENTION

1. Field of the Invention

The present invention relates to a method and apparatus for pre-determining the withdrawal/release force required to disconnect an appliance coupler such as a plug and socket. The invention also relates to a method and apparatus for preventing disconnection of an appliance coupler such as a plug from a socket. Furthermore, the invention relates to method and apparatus for preventing inadvertent or unintentional disconnection of a plug from a socket for the supply of electrical power to a medical apparatus.

2. Discussion of Related Art

An appliance coupler enables the connection and disconnection at will, of a cord to an appliance or other equipment and it consists of two parts: a connector and an appliance inlet. Often the connector takes the form of a plug while the appliance inlet takes the form of a socket. Typically the cord is intended to deliver electrical power such as AC or DC current to the appliance. Alternatively, a cord may be intended to serve as the conductor for the transmission of data.

It is common that where an electrical connection is effected by utilization of a plug and socket, the combination must be capable of being connected and disconnected by the plug being inserted and withdrawn from the socket with the use of no more than a strength or force which may be easily exerted by unaided manual effort. The minimum force required to disconnect the plug and socket may be referred to as the withdrawal force. The withdrawal force is exerted by way of a pull force which is a force applied to the plug and socket combination which tends to separate the connection. Notwithstanding the ease by which a plug may be disconnected from a socket, there may be situations such as when the apparatus is operating where the plug is required to withstand a pull force that is significantly greater than the withdrawal force. These otherwise conflicting requirements may be satisfied by the provision of a retaining component that operates independently of the retaining effect achieved by the otherwise unaided plug and socket combination.

Generally, the plug and corresponding socket are configured to slidably engage one another, the socket having slots to a depth of at least the length of the pins. The pins may protrude from a support structure or be integral with the support structure. The pins may be constructed from a conductor, such as metal or some combination of support structure having a conductive component. The slots are generally housed within a structure having insulating properties. Generally there is a frictional retaining force between the pins and their corresponding slots. In addition, in some plug and socket arrangements, the housing of each of the respective plug and socket provides a frictional retaining force. This frictional retaining force will tend to oppose a pull force and thus contribute to the level of withdrawal force required to cause a disconnection to the plug and socket.

In one form commonly used in Australia for transmission of electrical power between the wall socket and the cord, the relevant standard mandates the use of a set of three pins in the plug. One pin may be used as an "earth" or ground, as known in the U.S., the other two pins may be respectively "active" and "neutral". The pins are generally flat and rectangular, having approximate dimensions of 1.5 mm thick×20 mm long×5 mm wide. The pins are arranged around a central point. An earth pin is arranged approximately radially to the central point, whereas the other two pins are arranged generally tangentially. The slots within the socket are arranged to receive the pins of the plug, there being a corresponding slot for each pin. In this way, there is a unique orientation for engaging the plug and socket together. In another form commonly used in Australia for transmission of electrical power, only two pins are used, the earth pin being omitted. In some European countries, a set of two cylindrical pins is used. In the United States, plugs having a generally cylindrical earth (ground) pin and two generally flat rectangular pins are commonly used. Other arrangements of pins and sockets are known.

There are international standards for the point of connection between the cord and the electrical appliance. Those standards often include a specified withdrawal force for the plug and socket combination.

In another form of electrical power cord, the cord has a wall socket engaging plug at one end and a device engaging housing at the other end. FIG. 1 shows a known device engaging housing 10. The device engaging housing 10 is generally rectangular and has a first end connected to the cord and a second end 12 for connection with an apparatus. The second end 12 has a generally irregular hexagonal "extruded" profile. The length of the "extrusion" is approximately 19 mm and the length of the device engaging housing 10 is approximately 55 mm. In use, the device engaging housing 10 is positioned in front of a socket 20 having a negative generally irregular hexagonal shape, the socket 20 being positioned on the exterior of the apparatus 5 and sided therein. FIG. 2 shows a known socket. The device engaging housing 10, can generally be inserted for the length of the generally irregular hexagonal profile, which is to say, approximately 19 mm. There are three flat rectangular pins 25 within the socket 20 of the apparatus which slide into corresponding slots 15 within the device engaging housing 10. A retaining force between the device engaging housing 10 of the cord and the socket 20 of the apparatus is provided by a frictional force between engaging surfaces, such as (i) the exterior walls 17 of the second end 12 of the device engaging housing 10 and the interior walls 27 of the socket 20 within the apparatus; and (ii) the exterior surface of the pins 25 and the interior walls of the slots 15. In the case of the plug and socket depicted in FIGS. 1 and 2, the withdrawal force is relatively low, since the only retaining force is due to friction between the plug and socket.

Other fields also use arrangements of plugs and sockets. In the field of data communication, for example via a telephone network, it is known to provide plug and corresponding socket sets which include a retaining device. Such an arrangement is depicted in FIGS. 3(*a*)–3(*c*) and FIGS. 4(*a*) and 4(*b*). FIGS. 3*a*, 3*b* and 3*c* depict front, side and top view respectively of a known plug 30. FIGS. 4*a* and 4*b* depict front and side views respectively of a known socket 40. Such a plug and socket combination is general known as RJ series connectors.

Plug 30 includes a cantilevered arm 32 and is able to pivot about a pivoting point when subject to a force. The arm 32 is resiliently biased in an upper position. As best shown in FIG. 3(*c*), the arm 32 has a wide portion 34 and a narrow portion 36. At the junction between the wide and narrow portions 34, 36 is a pair of shoulder regions 38.

Socket 40 is adapted to slidingly receive within it plug 30 and hence socket 40 has a shape generally complementary to the plug 30. Socket 40 includes a shoulder 48 adapted to engage the shoulder 38 of the plug 30. Whilst plug 30 is being inserted into socket 40, the cantilevered arm 32 must pivot into a lower position. Once the plug 30 is fully inserted into socket 40, the arm 32 springs back into the upper position and the respective shoulder regions 38 and 48 engage one another. Hence the plug 30 is retained within the socket 40. The plug 30 and socket 40 will not disengage until the arm 32 is depressed into the lower position, disengaging the two shoulders 38 and 48. In some situations where the extreme pull force is applied to the cable or plug 30, the arm 32 may break off or be damaged by permanent deformation.

Another known arrangement from the field of data communications for retaining plugs and sockets together is depicted in FIGS. 5 and 6. In this arrangement, pins 54 located within the plug 50 are arranged to slidingly engage with slots 64 within the socket 60. In this arrangement, plug 50 and socket 60 are primarily retained via screws 52 in the plug 50 which are adapted to engage with corresponding slots 62 having a thread complementary to the screws 52. In addition, a friction fit occurs between the pins and slots and between the sheath 55 and the corresponding inner surfaces of socket 60. Disconnecting this plug and socket combination without first unscrewing each screw 52 would result in damage to the screws or their reciprocal threaded bores or the integrity of the plug and socket or the fixture of the socket to the attached apparatus.

A problem with the known arrangements for retaining the connectors and appliance inlet together is that the withdrawal force is either too low to satisfy some operation situations in that the connector disconnects from the appliance inlet when subject to pull forces that are often encountered in the operating environment. Alternatively, the withdrawal force is so high that physical damage may result to the connector and appliance inlet before the connector disconnects from the appliance inlet. For example, in the case where a screw is used to hold the connector and appliance inlet together, other parts of the connector and appliance inlet may break before the screw disengages. Where such an arrangement to be used for power cables, it may be that live wires break or become exposed to the environment before the screw disengages or the appliance may be otherwise damaged. As a further undesirable consequence, the connector may separate from the attached power cord or the appliance inlet may separate from the rest of the appliance. In each instance the separation of components may cause short circuits or even live electrical leads to be exposed to the environment thereby giving rise to a situation where further appliance damage, electrocution, arcing and ignition of fire may occur. Further, the power cord, connector, appliance inlet or retaining device may become damaged and rendered in a condition that would be unsuitable for further use.

In addition to the general standards for appliance couplers, additional standards proclaimed by international or national standards organizations or by sectional bodies (such as those responsible for setting medical apparatus standards) may require a unique withdrawal force to be implemented in particular applications. For example, see proposed standard ISO/TC 121/SC 3N 1066 titled Lung Ventilators and Related Equipment dated Jul. 8, 2001 published by International Organization for Standardization (ISO).

In other instances, it may be desirable that where a set of cords are arranged in series and connected by complementary plugs and sockets engaging with each other, that the engaged complementary plugs and sockets are able to withstand a pull force up to a specified limit without disconnecting. While such a connection may be achieved, by not ensuring that there is a maximum force above which the connected pins and sockets will disengage there is the risk that a sufficiently high pull force will cause damage to the components. The present invention may be used in the connection of sets of cords.

A problem with the known plugs and sockets described above, and by way of example only as depicted in FIG. 1 and FIG. 2 is that the retaining force between the plug and socket due to friction between corresponding complementary slidingly engaged surfaces does not meet the regulatory requirement of withstanding an industry or apparatus specific standard standards. In this example, the standard force would be set at a minimum, for example, to prevent inadvertent disconnection. In some industries, this may have a set standard of, for example, 100 Newtons. This is because the plug and socket combination are intended to stay connected during normal use while allowing for their disconnection to occur by the application of reasonable manually applied force. That is to say the plug and socket combination should be capable of being connected and disconnected without the need for the exertion of force that is greater than might reasonably be applied by a user without assistance. Moreover, the plug should not be designed such that the withdrawal force exceeds the strength limits of the plug and associated wires. Thus, for example, the maximum withdrawal force may be set, for example, at 300 Newtons.

A preferred aim of the present invention is to satisfy a requirement that a detachable cord with a plug withstand a pull force (defined as an axial pull of force) of the magnitude of, for example, greater than 100 to less than 300 Newtons, but still be easily disconnected from a medical appliance by a user.

Another problem with the known plugs and sockets described above, and as depicted in FIG. 1 and FIG. 2 is that the retaining force between the plug and socket due to friction between corresponding complementary slidably engageable surfaces may be unpredictable in a mass produced componentry.

The multiplicity of safety and regulatory standards that may apply to a plug and socket combinations make it particularly difficult for achieving a single plug and socket combination which will meet different withdrawal force standards in different appliance applications or in different countries. Furthermore, while a standard may allow for the permanent attachment of a power cord or other electrical conductor cord to the appliance, from a manufacturer's perspective it is desirable to allow for the interchangeability of power cords through adoption of an appliance coupler so as to facilitate production and distribution of systems to satisfy a number of standards.

SUMMARY OF THE INVENTION

It is an aspect of the present invention to overcome or at least partially ameliorate problems with prior art solutions.

In this specification, the term "comprising" is used non exclusively. That is, a device "comprising features a, b and c" is to be understood to have the possibility of having features in addition to features a, b and c.

In this specification, the term "release force" will be used to describe the force required to disengage a connector and appliance inlet whilst the two are held together via a retaining arrangement.

In this specification, reference to a plug and a socket will be understood to include appliance couplers generally.

In accordance with one aspect of the invention, there is provided a method of configuring a retaining clip in which the retaining clip will disengage at a predetermined release force.

In accordance with an embodiment of the invention there is provided a retaining clip for appliance coupler, that will disengage at a predetermined release force.

In one form, the invention provides a means for predetermining the withdrawal force for a plug and socket assembly.

In another form, the invention provides a means for predetermining the inadvertent or unintentional release force for a plug and socket assembly.

In accordance with a further aspect of the invention, there is provided a retaining clip adapted to engage a plug and a socket.

In accordance with a further embodiment of the invention there is provided a plug retaining assembly comprising a plug, a socket and a retainer clip wherein the plug and the retaining clip include respective complementarily engaging mechanisms adapted to disengage at a predetermined release force.

In accordance with a further embodiment of the invention, there is provided a plug retaining assembly comprising a plug, a socket and a retaining clip wherein the plug includes a lug and the retaining clip includes a lug engaging mechanism, adapted to disengage at a predetermined release force.

In accordance with a further embodiment of the invention, there is provided a method of changing the release force of a plug retaining assembly comprising a plug, a socket and a retaining clip wherein the plug includes a lug and the retaining clip includes a lug engaging mechanism having a wedge angle which is adapted to disengage at a predetermined release force. The method may include changing the wedge angle.

In accordance with a further embodiment of the invention, there is provided a method of changing the release force of a plug retaining assembly comprising a plug, a socket and a retaining clip wherein the plug includes lug and the retaining clip includes a lug engaging mechanism having a wedge angle which is adapted to disengage at a predetermined release force. The method may include changing the resilience of the retaining clip.

Preferably the method of configuring a plug retaining assembly which will allow the plug to disconnect from the socket at a predetermined release force includes the ability to reconfigure the plug retaining assembly so that after the plug has disconnected due to being subjected to at least the release force, the plug may be reconnected to the socket and remain connected to the socket until again subjected to the release force.

Preferably the method of configuring a plug retaining assembly includes the ability for a user to disconnect the plug from the socket by application of a withdrawal force that is substantially less than the release force required to disconnect the plug from the socket when the retaining clip is used.

BRIEF DESCRIPTION OF THE DRAWINGS

FIGS. 8(*a*), (*b*), (*c*) & (*d*) show different views of a plug in accordance with an embodiment of the invention.

DETAILED DESCRIPTION OF PREFERRED EMBODIMENTS OF THE INVENTION

A description of preferred embodiments of the invention will now be provided. In one form, apparatus according to the invention comprises three components: (i) a socket, ii) a plug, and (iii) a retaining clip. Each of these components will now be described.

Figure 1:
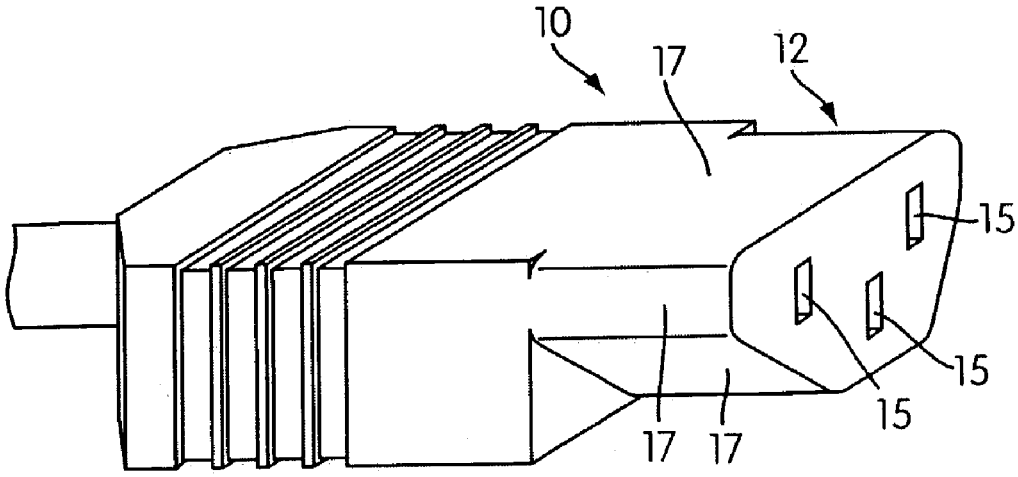
FIG. 1 PRIOR ART
FIG. 1 shows a prior art plug.
Figure 2:
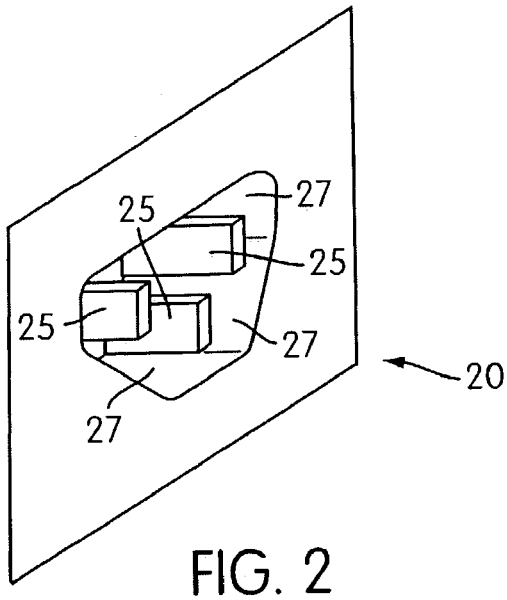
FIG. 2 PRIOR ART
FIG. 2 shows a prior art socket.
Figure 3A:
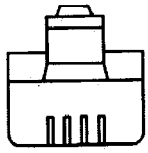
FIG. 3(a) PRIOR ART
FIG. 3 shows a prior art plug.
Figure 3B:
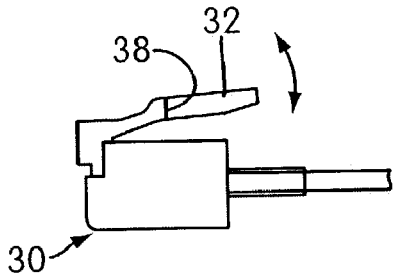
FIG. 3(b) PRIOR ART
Figure 3C:
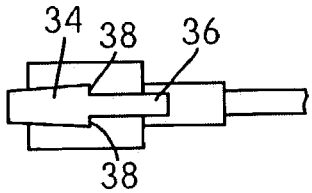
FIG. 3(c) PRIOR ART
Figure 4A:
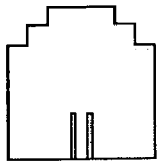
FIG. 4(a) PRIOR ART
FIG. 4 shows a prior art socket.
Figure 4B:
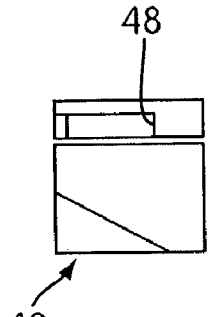
FIG. 4(b) PRIOR ART
Figure 5:
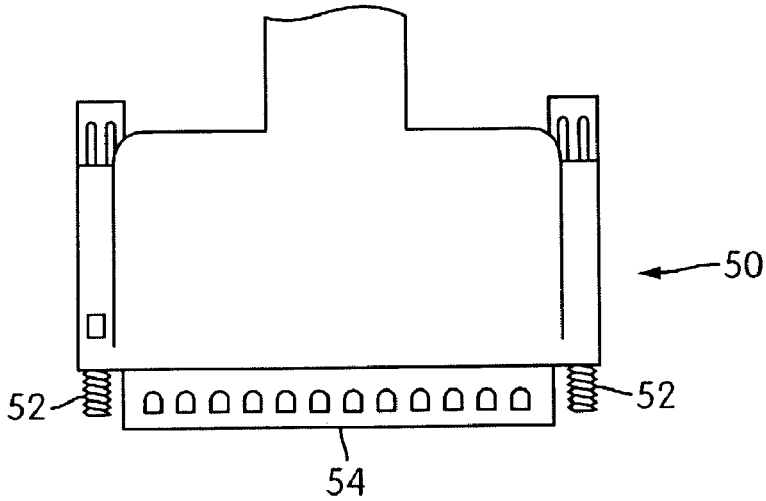
FIG. 5 PRIOR ART
FIG. 5 shows a prior art plug.
Figure 6:
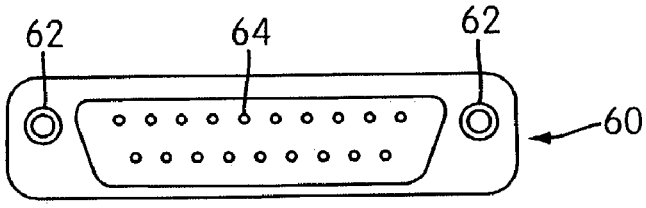
FIG. 6 PRIOR ART
FIG. 6 shows a prior art socket.
Figure 7B:
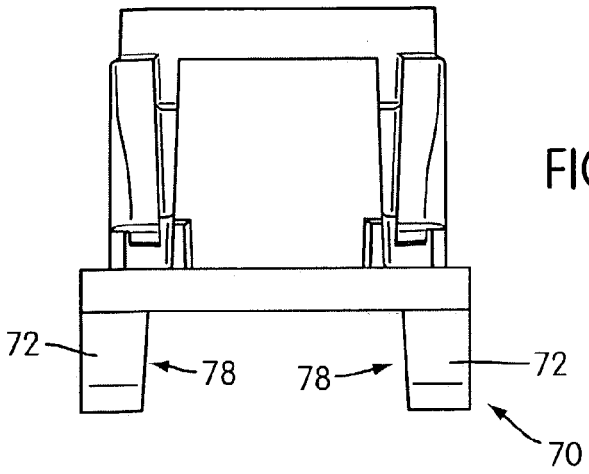
FIGS. 7(*a*), (*b*) & (*c*) show a cartridge in accordance with an embodiment of the invention.
Figure 7A:
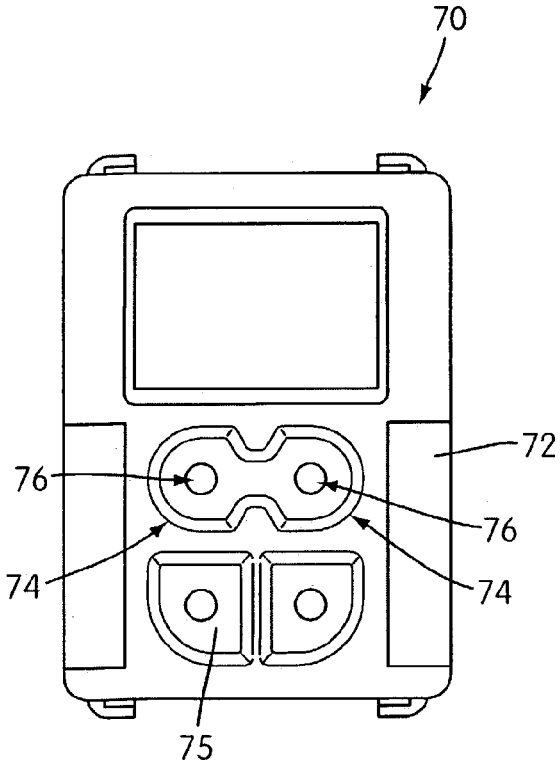
Figure 7C:
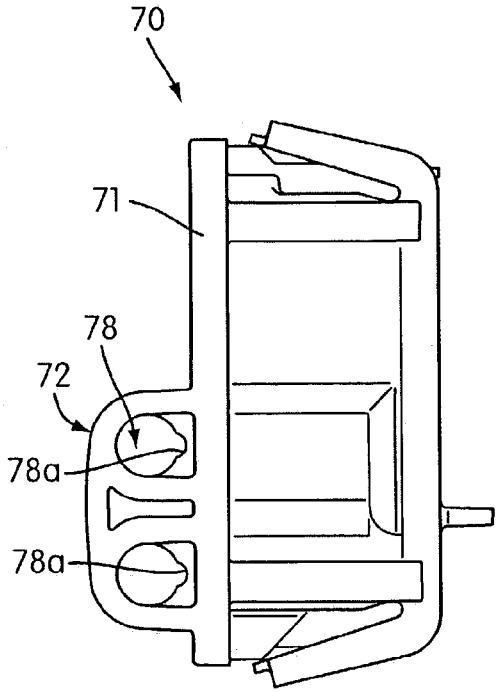
Figure 9B:
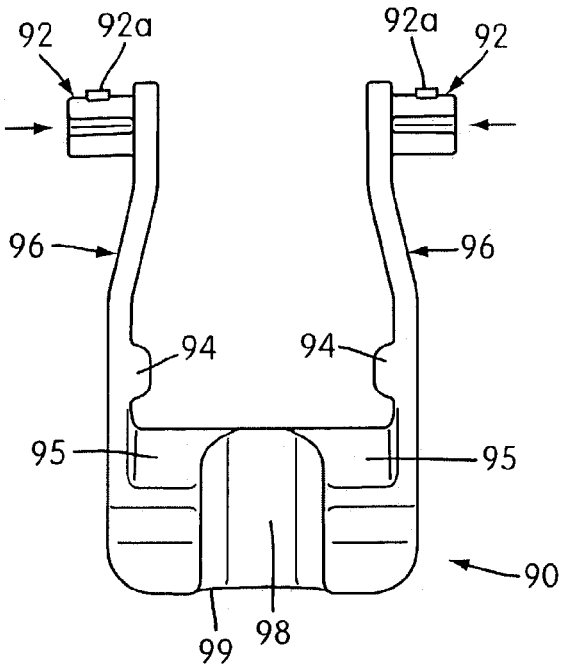
FIGS. 9(*a*), (*b*), (*c*) & (*d*) show a retaining clip in accordance with an embodiment of the invention.
Figure 9C:
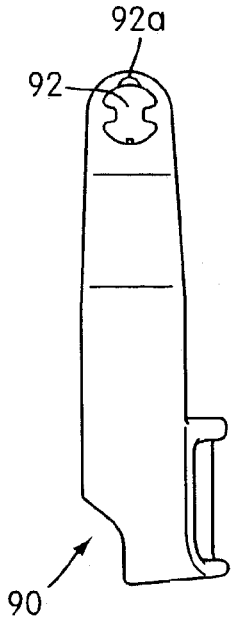
Figure 9A:
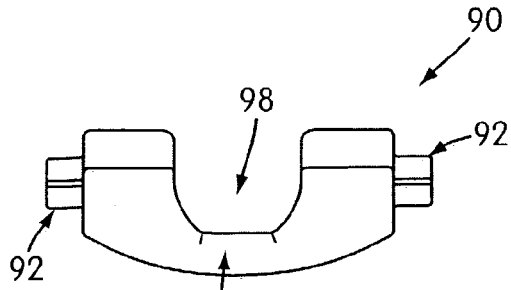
Figure 9D:
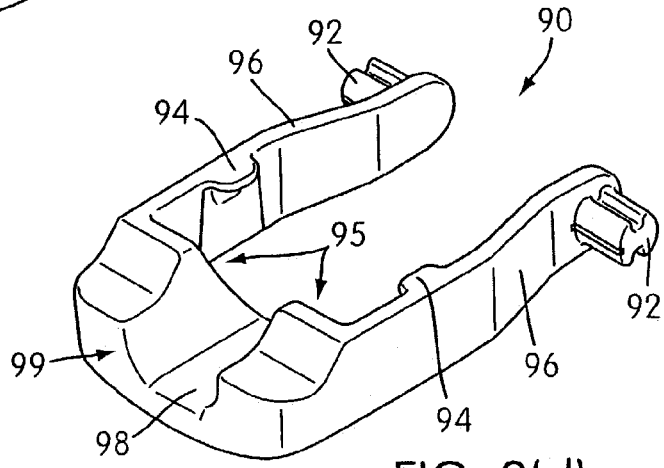

A socket in accordance with an embodiment of the invention suitable for use with a cord for supplying main power to medical apparatus may be configured as part of a removably insertable cartridge 70 as shown in FIG. 7. The cartridge 70 is inserted or otherwise secured to an aperture in the housing of the medical apparatus (not shown). The cartridge 70 has a surface 71 which is generally flush with the surface of the housing when the cartridge-70 is inserted into the housing. Extending into the cartridge 70 from the surface of the cartridge there is a pair of generally D-shaped slots 74. The slots 74 have an approximate depth of 16 mm, which is a standard measurement in this example. Each D shaped slot 74 as an approximate diameter of 9 mm. The pair of D shaped slots 74 are arranged side by side with their backs to one another. In the centre of each slot is a generally cylindrical pin 76 which extends the length of the slot 74, which is to say, approximately 9 mm. The pin 76 provides for electrical contact with the plug when the plug is inserted. In accordance with another form of the invention, the socket comprises a single generally trapezoidal shaped slot instead of the pair of D-shaped slots as depicted in FIG. 7(*a*). On either side of the slots 74 and positioned on the surface 71 of the cartridge 70 is a pair of lugs 72 each having a cylindrical bore 78 therethrough. The lugs 72 are adapted to engage with and allow for the pivoting of the retaining clip. The bore 78 has an approximate diameter of 4.5 mm. The bore 78 also includes a notch 78*a*, whose function will be described below in relation to FIG. 10(*b*). In accordance with a preferred embodiment, the lugs 72 are generally D shaped, however other shapes, such as rectangular may also be used, provided that they have sufficient strength to support the retaining clip 90 (FIGS. 9(*a*)–9(*d*)).

For clarity it is noted that the cartridge of FIGS. 7(*a*)–7(*c*) depicts both a pair of D shaped slots 74 and a pair of slots comprising two generally square recesses 75.

In accordance with another embodiment of the invention, the pair of slots 74 comprises two generally square recesses having one corner of each square rounded for polarization. There is a thin dividing wall between the two recesses.

A plug 80 in accordance with an embodiment of the invention is shown in FIGS. 8(*a*), 8(*b*) 8(*c*) and 8(*d*) in end, plan and perspective views respectively. The plug 80 includes a pair of lugs 82 and a pair of pin receiving slots 84 adapted to receive the pins 76 of the cartridge 70. An end 86 of the plug 80 is adapted to be slidably inserted within the slots 74 of the socket of cartridge 70. In this way a portion of the length of the plug 80 is received within the cartridge 70, however the lugs 82 remain outside of the slots 74 in order that the retaining clip sloping surfaces 95 are able to engage with the retaining clip 90. In another form of the invention, where a cartridge 70 has a single generally trapezoidal slot instead of a pair of slots 74, the plug 80 has a corresponding shape so as to be insertable within the generally trapezoidal slot. In another form of the invention, there is only one lug 82 on the plug 80.

Figure 10A:
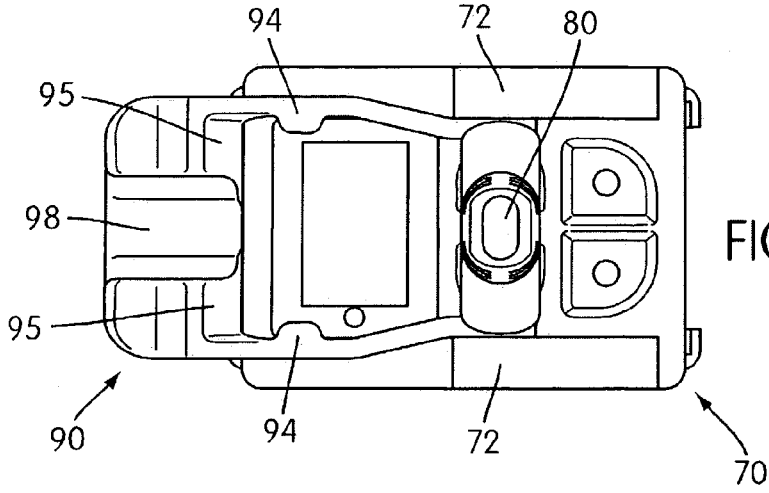
FIGS. 10(*a*) & (*b*) show a plug, retaining clip and cartridge assembly in accordance with an embodiment of the invention.
Figure 11:
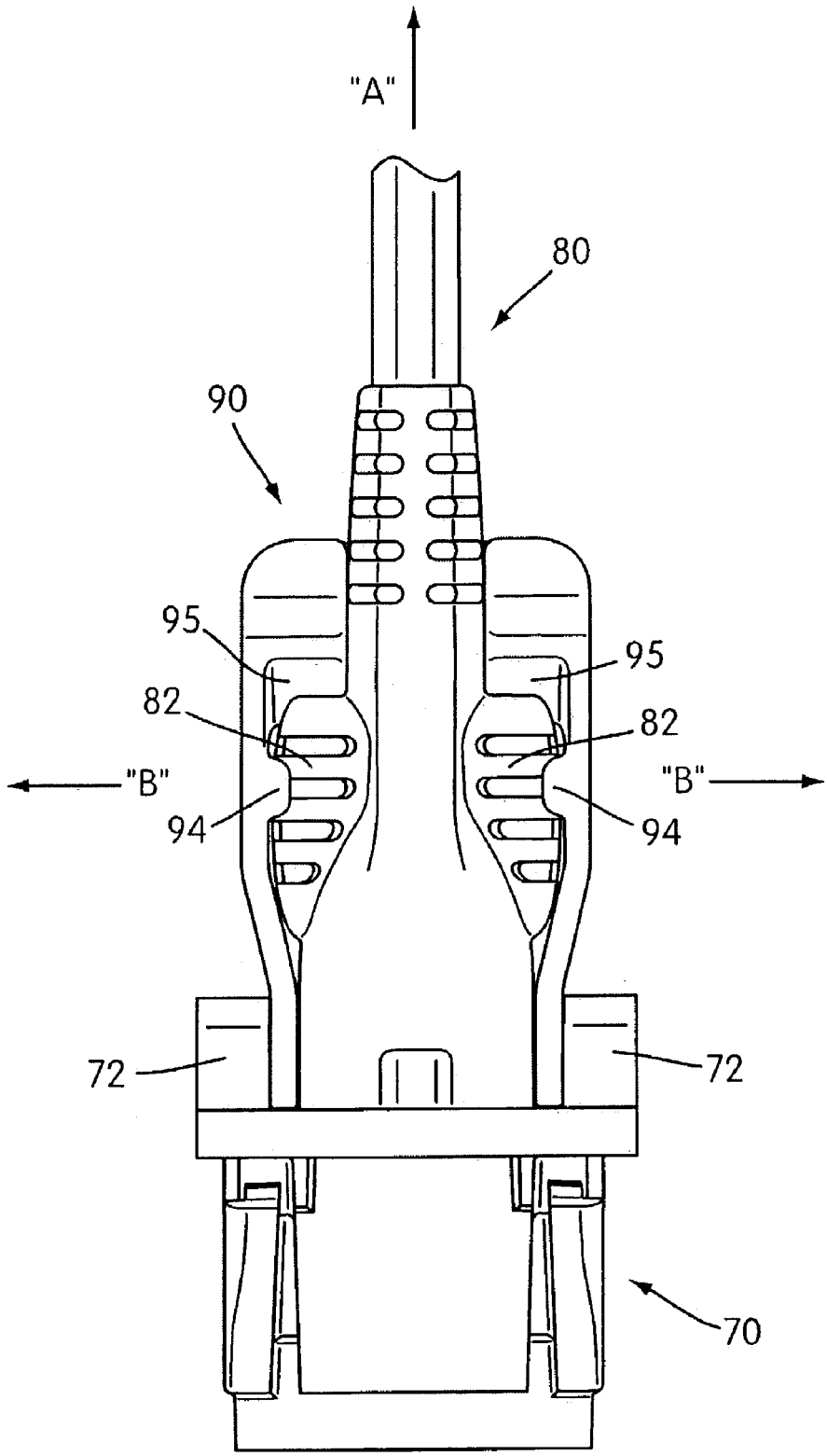
FIG. 11 shows a plug, retaining clip and cartridge assembly in accordance with an embodiment of the invention.
Figure 12:
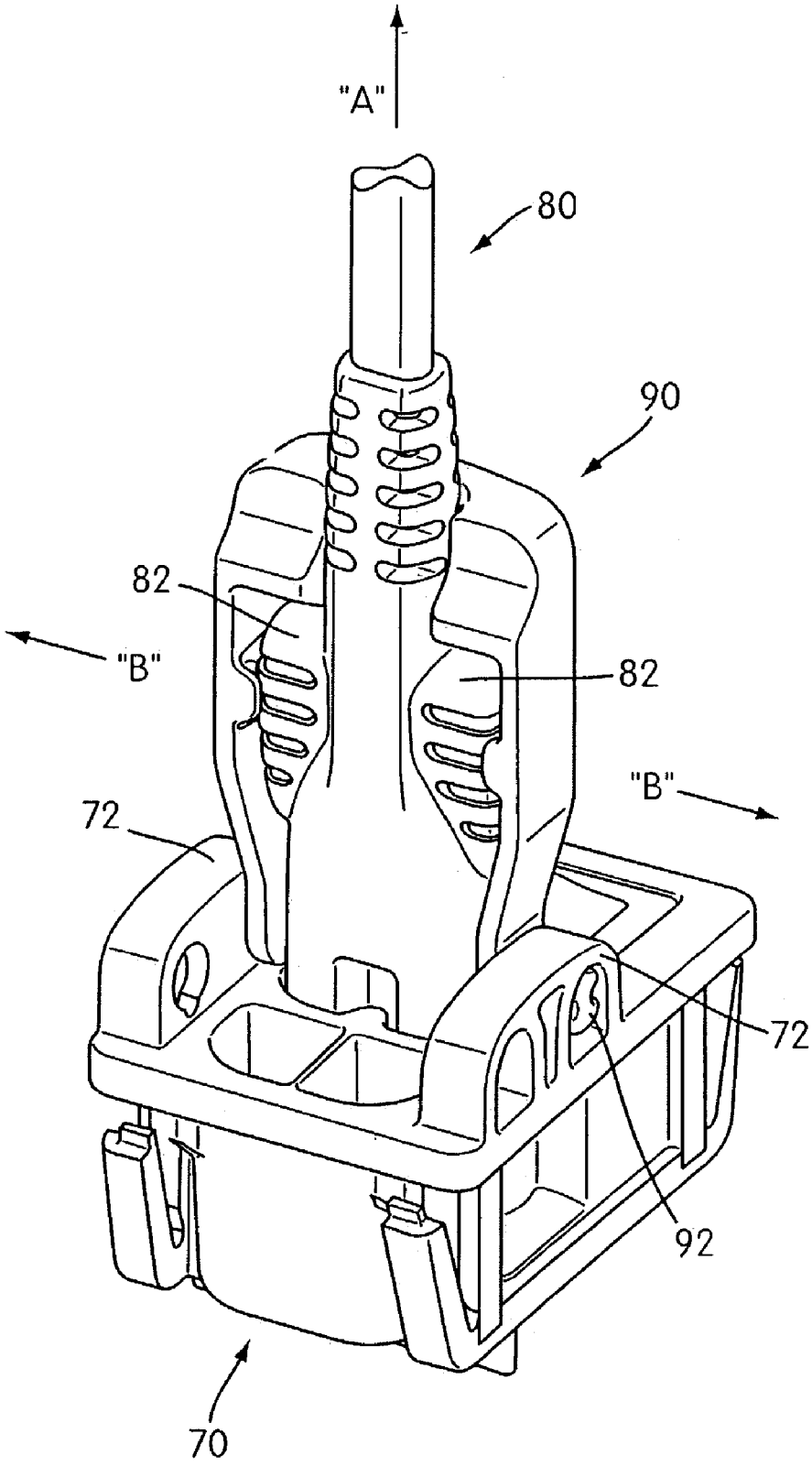
FIG. 12 shows a plug, retaining clip and cartridge assembly in accordance with an embodiment of the invention.

A retaining clip 90 in accordance with an embodiment of the invention is shown in FIGS. 9(*a*), 9(*b*), 9(*c*) and 9(*d*) in end, plan, side and perspective views respectively. The retaining clip 90 includes a pair of pins 92 and a pair of tabs 94, one tab 94 being positioned at each of the respective ends of a pair of arms 96. One or both pins include a cam or protrusion, whose function will be described below in relation to FIG. 10(*b*). The arms 96 are resiliently bendable in the direction of the arrows on FIG. 9(*b*) and at the end of their length opposite the pair of pins 92 are joined by a bridge piece 99. The pins 92 are adapted to be inserted within the bores 78 of the lugs 72 of the cartridge 70, as depicted in FIGS. 10(*a*)–12. Once the pins 92 are so inserted, the retaining clip 90 is able to pivot about the pins 92 as depicted in FIG. 10(*b*). In one form, the retaining clip 90 is only insertable in the cartridge 70 when the plug 80 is not inserted in the cartridge 70. The retaining clip 90 is shown in a horizontal position in FIG. 10(*b*), however once the retaining clip 90 is pivoted into the vertical position as shown in FIGS. 11 and 12, the tabs 94 are adapted to engage with the lugs 82 of the plug 80. The retaining clip 90 includes in its bridge piece 99 a groove 98 adapted to receive within it an upper portion 88 of the plug 80 or cord.. The retaining clip 90 includes a pair of sloping surfaces 95.

Figure 10B:
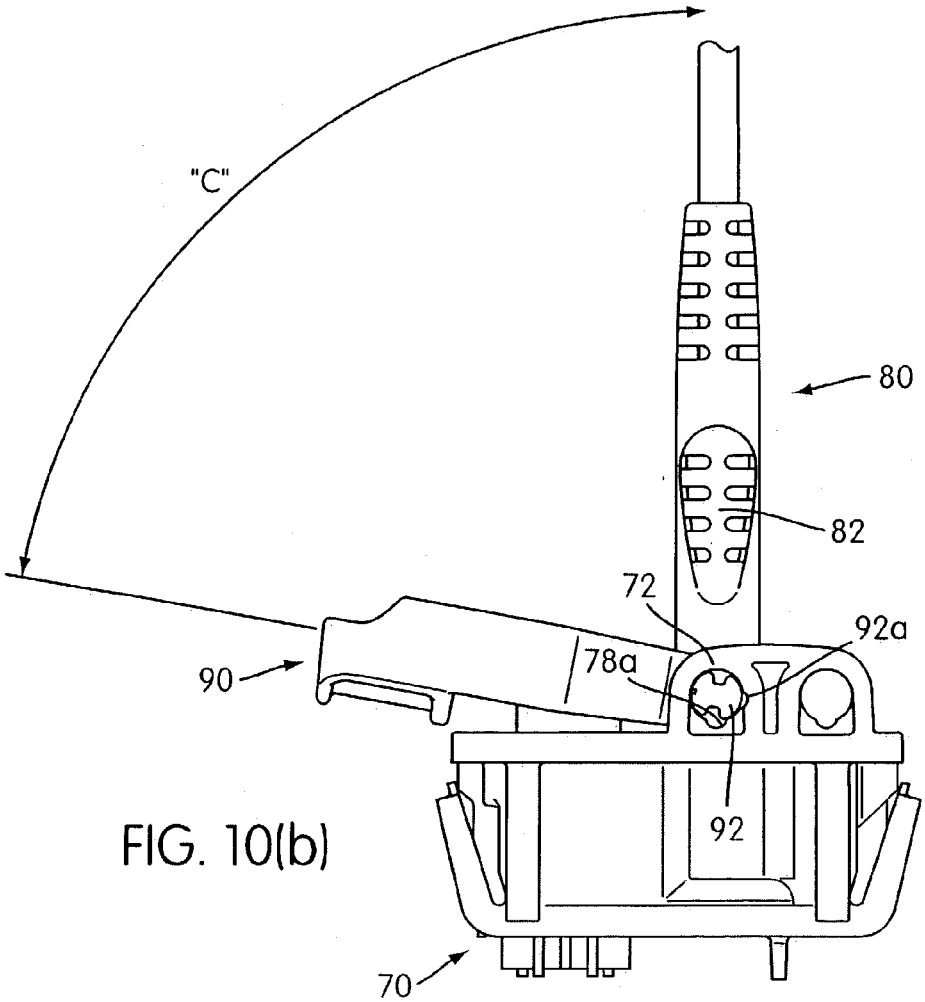

FIGS. 10(*a*) and (*b*) show the assembly of socket 70, plug 80 and retaining clip 90 in a non-locking position. The retaining clip 90 was placed in position in the lugs 72 of the cartridge 70 prior to the slidable insertion of the plug 80. In order to lock the plug 80 in position, the retaining clip 90 has to be rotated approximately 90 degrees from the position shown in FIG. 10*b* to the position shown in FIGS. 11 and 12. In the process of the retaining clip 90 rotating and engaging with the plug 80, the arms 96 deform slightly so as to enable the tabs 94 to pass over the lugs 82 of the plug 80. Once the tabs 94 have passed over the lugs 82, the retaining clip 90 is prevented from rotating, being in this way locked into position until the plug is removed.

As shown in FIG. 10(*b*), the notch 78*a* and the cam or protrusion 92*a* (both described above) are designed to align when the clip 90 is rotated in the direction of arrow "C". The cam or protrusion 92*a* can be positioned in conjunction with the inner surface of 78 (FIG. 7*c*) to provide the friction to hold the clip 90 vertically (up or down). This holds the clip 90 clear of the plug connection allowing for easier assembly. The notch and cam/protrusion can be formed in other positions, instead of the exemplary position illustrated, so that the clip 90 is held in other temporary positions during assembly.

The plug 80 may be removed from the assembly by withdrawing it in the direction of arrow A shown in FIGS. 11 and 12. In the process of withdrawing the plug 80 in that direction, the arms 96 of the retaining clip 90 deform slightly in the direction of arrow B so as to enable the lugs 82 to disengage. Furthermore in the process of withdrawing the plug 80 in the direction of arrow A, the lugs 82 pass over the respective corresponding sloping surfaces 95. The force required to withdraw the plug 80 from the assembly is dependent upon a number of factors, including (i) the resilience of the arms 96, (ii) the friction between the lugs 82 and the tabs 94 and (iii) the friction between the lugs 82 and the sloping surfaces 95. Hence in order to adjust the force required to withdraw the plug 80 from the assembly, each of these factors (i), (ii) and (iii) may be individually or severally adjusted.

Once the plug is connected to the socket and the retaining clip is positioned to retain the plug connected to the socket then the plug may be disconnected by withdrawal from the socket in either of two ways. In the first way the plug withdrawal occurs as a two step, sequential manner whereby the retaining clip is first disengaged from the plug and then the plug is withdrawn from the socket. In the second way the disengagement of the retaining clip and at least the partial withdrawal of the plug from socket occur simultaneously.

The first way to withdraw the plug from the socket is the way that will typically occur in the absence for an inadvertent or unintentional withdrawal force being applied to the plug or its attached cord or the apparatus. This may be considered to be a two step way. First the retaining clip is released from the plug in a manner that is the reverse of the way that the retaining clip is positioned when the plug is connected to the socket. As part of this process sufficient force is applied to the retaining clip so as to cause the arms 96 to deform as the tabs 96 have passed over the lugs 82. The retaining clip 90 is free of the plug. That is to say the retaining clip is rotated from the position shown in FIG. 11 and FIG. 12 to the position shown in FIG. 10. Once the retaining clip has become disengaged from the plug then the plug maybe withdrawn from the socket in the usual manner suited to the plug and socket combination. At this stage the force required to withdrawal the plug will be less than the release force that would cause the plug and retaining clip assembly to yield.

The second way to withdraw the plug from the socket is the way that may occur when an inadvertent or unintentional withdrawal force is applied to the plug, its attached cord or the apparatus. In the second way the disengagement of the retaining clip and at least the partial withdrawal of the plug from socket occur simultaneously. This may be considered to be a one step way.

Because of the capacity to adjust a number of factors that will influence the force required to withdraw the plug from the socket while utilizing the retaining clip it is possible to control the forces required to achieve the above described sequential (two step) and simultaneous (one step) ways described above. The invention may be practiced so as to achieve a high release force threshold for plug withdrawal in the one step way, i.e., make the connected plug and socket combination resistant to inadvertent or unintentional withdrawal forces of high magnitude such as 100 to 300 Newtons while also allowing for the easy detachment for the retaining clip when practicing the two step way. In this embodiment this is achieved by allowing for the retaining clip to be detached from the plug by application of a force that is approximately perpendicular to the plug and socket combination. Typically the force that is approximately perpendicular to the plug and socket will be of such a magnitude that it may be easily applied by one hand of any typical user.

A method for determining the appropriate release force for a plug, socket and retaining clip combination is to take into consideration external determinants such as standards that may apply, e.g., a breathing apparatus standard that requires the connector to withstand a withdrawal force of 300 Newtons for one minute. Once all external determinants of a minimum withdrawal force have been satisfied, then the issue of the actual release force maybe determined.

A way that the release force is determined is by consideration of other aspects of the apparatus to which the retaining clip is to be used. For example, the force required to move the apparatus in the direction of a pull force transmitted via the cord could be used as a determinant. In a typical situation it would be desirable to set a maximum release force at a level such that the retaining clip releases rather than applying to the apparatus sufficient pull force to move the apparatus. Such an arrangement will serve to prevent the apparatus from moving from one level to a lower planar level as a result of a pull force being transmitted to the apparatus. A benefit of the invention would be that an apparatus free standing on a trolley or other stand would not be pulled to the edge of the trolley or stand and risk falling onto a person or floor because the release clip would release and allow for the plug to disconnect by withdrawal from the apparatus inlet before sufficient pull force is transmitted to the cause the apparatus to move to the edge of the trolley or stand. Similarly, such an arrangement may be adopted so as to prevent the apparatus from being disconnected from other critical systems as a result of moving it in a direction that would otherwise cause disconnection.

For example, in accordance with the present invention, a breathing apparatus may be configured so that a pull force applied via the main power cord would cause the main power plug retaining clip to release and the main power plug to disconnect from the apparatus at a predetermined force in accordance with the present invention while the breathing apparatus remains connected to a supplementary power source such as a reserve battery source. Similarly, if the breathing apparatus were to be moved in a direction away from the main power source, the invention will allow for the main power plug to disconnect before the reserve power plug detached where the release force for the main power cord is less than the release force that applies to the connection between the reserve power source and the breathing apparatus. In this way the release force may be determined by reference to the force required to move the apparatus to which it is connected and by reference to the apparatus surface upon which the apparatus would move.

The planar surface movement may be influenced by consideration of the apparatus weight and the resistance to movement along the plane caused by the apparatus points of contact with the opposing surface. So in determining the withdrawal force, consideration may be given to the apparatus points of contact material and the opposing surface. These surfaces may be made of the same or different material, such as rubber feet for the apparatus and similar or different surface treatment for the opposing surface. These surfaces may be planar or may have a non-planar configuration which influences the movement of the apparatus. For example the apparatus may have feet upon which it sits in normal use, the feet contacting the surface upon which it would move should the pull force be applied via the cord. The feet may be made in one piece as the surrounding surface of the apparatus for example the feet being protruding mounds stamped for the apparatus metal casing or molded from apparatus plastic casing. Alternatively, the feet may be attached to the apparatus casing or to an apparatus component that passes through an aperture in the casing. The fixture of the feet may or may not serve to also retain the apparatus casing in place with respect to its internal components. The apparatus feet may then contact a planar opposing surface or engage with engaging points in the opposing surface such as indentations that are configured to receive the apparatus feet. Alternatively, the opposing surface may have ridges that rise to engage with the apparatus feet or casing. Similarly, the apparatus may have recesses to receive retaining protrusions from the opposing surface.

Such configurations will influence the force required to move the apparatus in any desired direction relevant to the opposing surface.

The retaining clip and plug combination of the present invention may be alternatively configured so that the plug embraces the retaining clip in the horizontal plane and moves in an angular fashion around that plane rather than in the earlier described embodiment where the retaining clip moves from the horizontal plane to the vertical plane.

In one preferred form, the socket is constructed from glass filled Nylon 66, the retaining clip is constructed from Nylon 66 and the plug uses flexible PVC overmolded on a cable and terminal assembly.

In another form, the invention further comprises appropriately located tabs situated on the clip such that should the release clip yield in response to the release force applied in an inadvertent or accidental manner, the tab would deform so as to provide visual indication of the event's occurrence. This aspect is of use to formally indicate the occurrence of such an event. By making the tab deform in such a manner that it is irreversible, notwithstanding that the plug may be reinserted into the socket and the retaining clip effect re-established, there would be a visual indication of the occurrence of an inadvertent or accidental plug withdrawal.

Figure 13A:
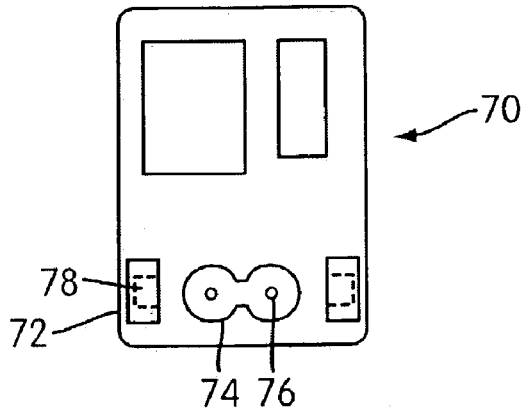
FIGS. 13(*a*), (*b*) & (*c*) show a cartridge in accordance with an embodiment of the invention.
Figure 13B:
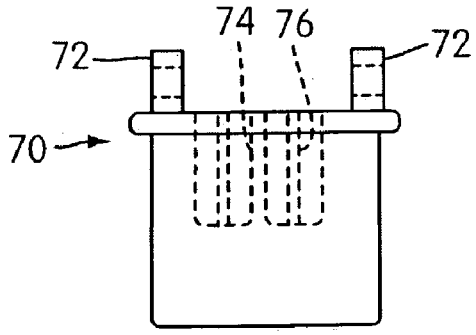
Figure 13C:
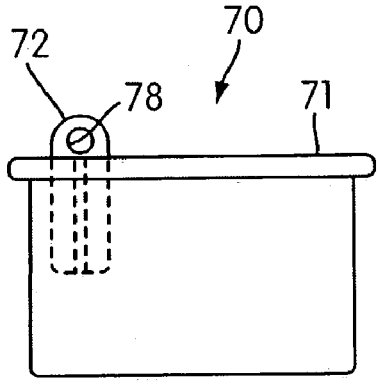
Figure 14A:
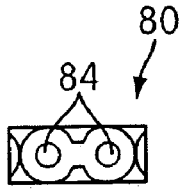
FIGS. 14(*a*), (*b*) & (*c*) show a plug in accordance with an embodiment of the invention.
Figure 14B:
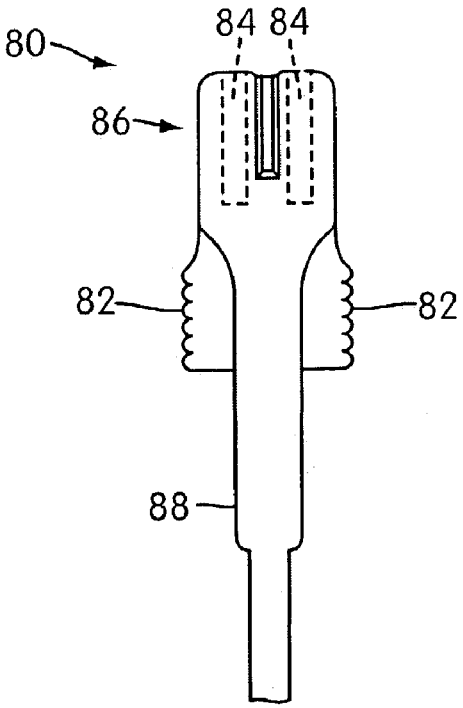
Figure 14C:
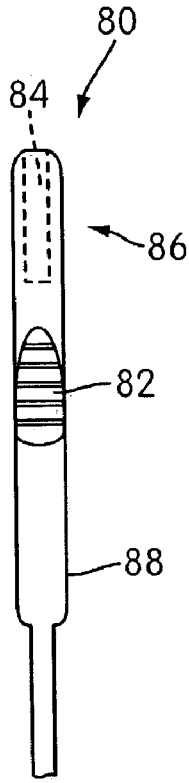
Figure 15A:
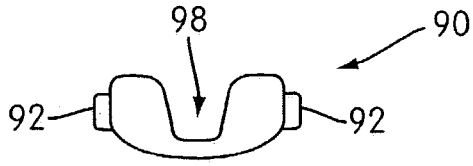
FIGS. 15(*a*), (*b*), (*c*) & (*d*) show a retaining clip in accordance with an embodiment of the invention.
Figure 15B:
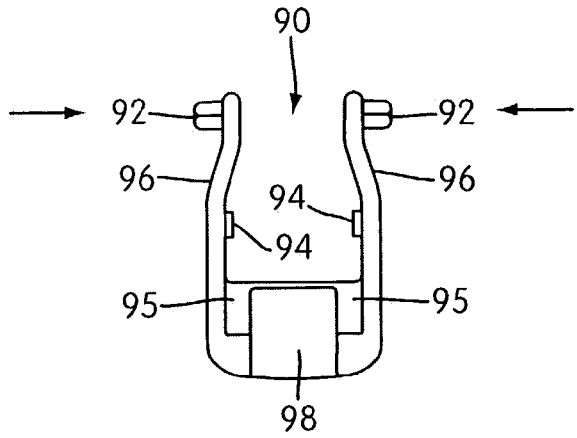
Figure 15C:
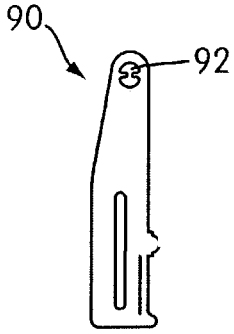
Figure 15D:
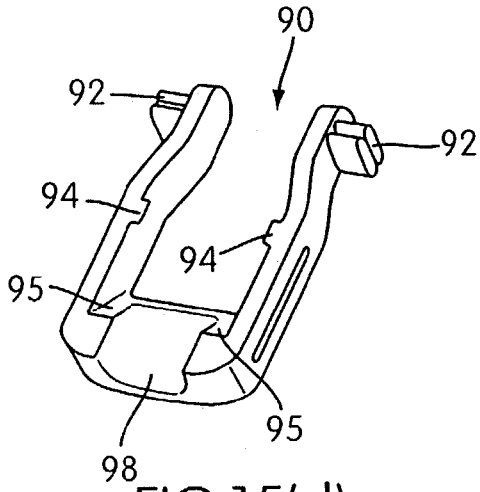
Figure 16A:
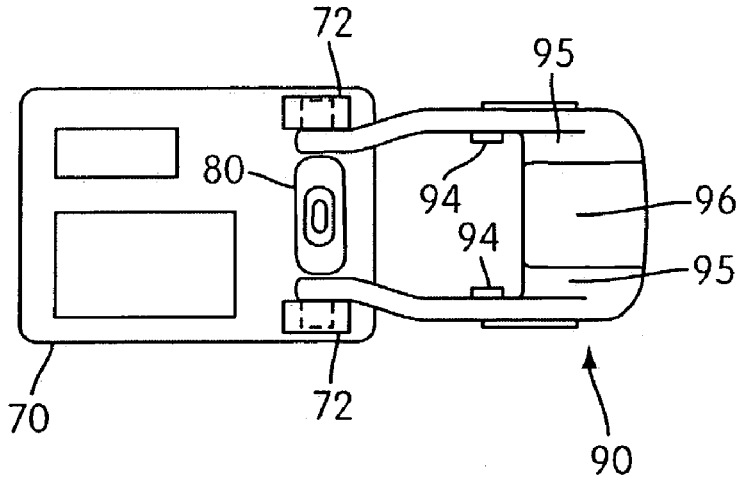
FIGS. 16(*a*) & (*b*) show a plug, retaining clip and cartridge assembly in accordance with an embodiment of the invention.
Figure 16B:
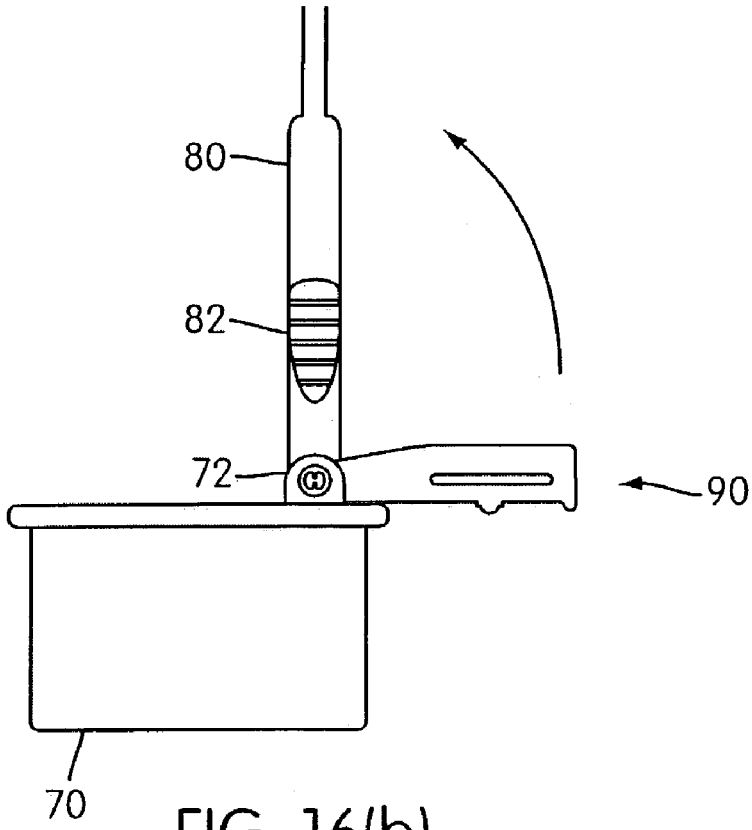
Figure 17:
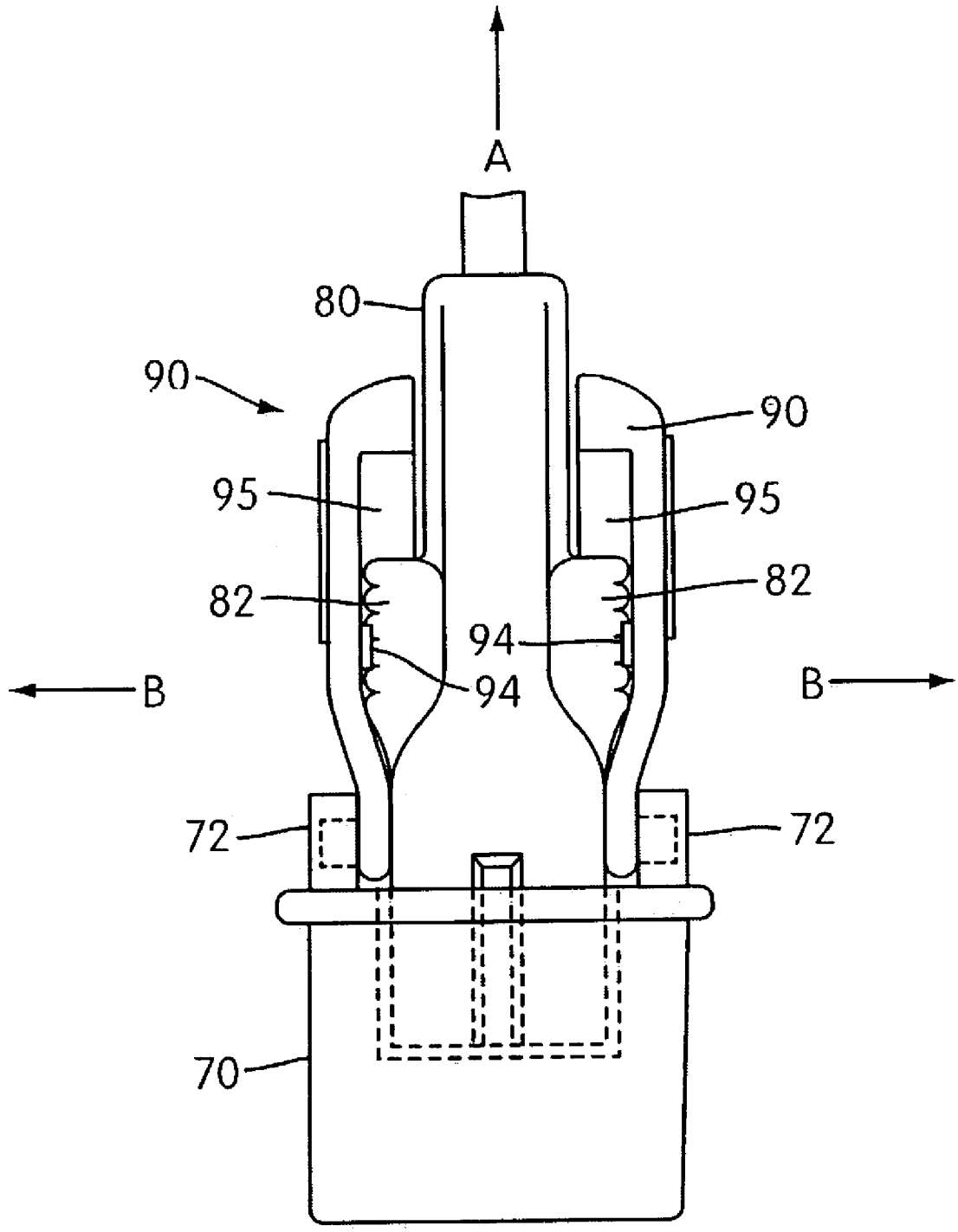
FIG. 17 shows a plug, retaining clip and cartridge assembly in accordance with an embodiment of the invention.
Figure 18:
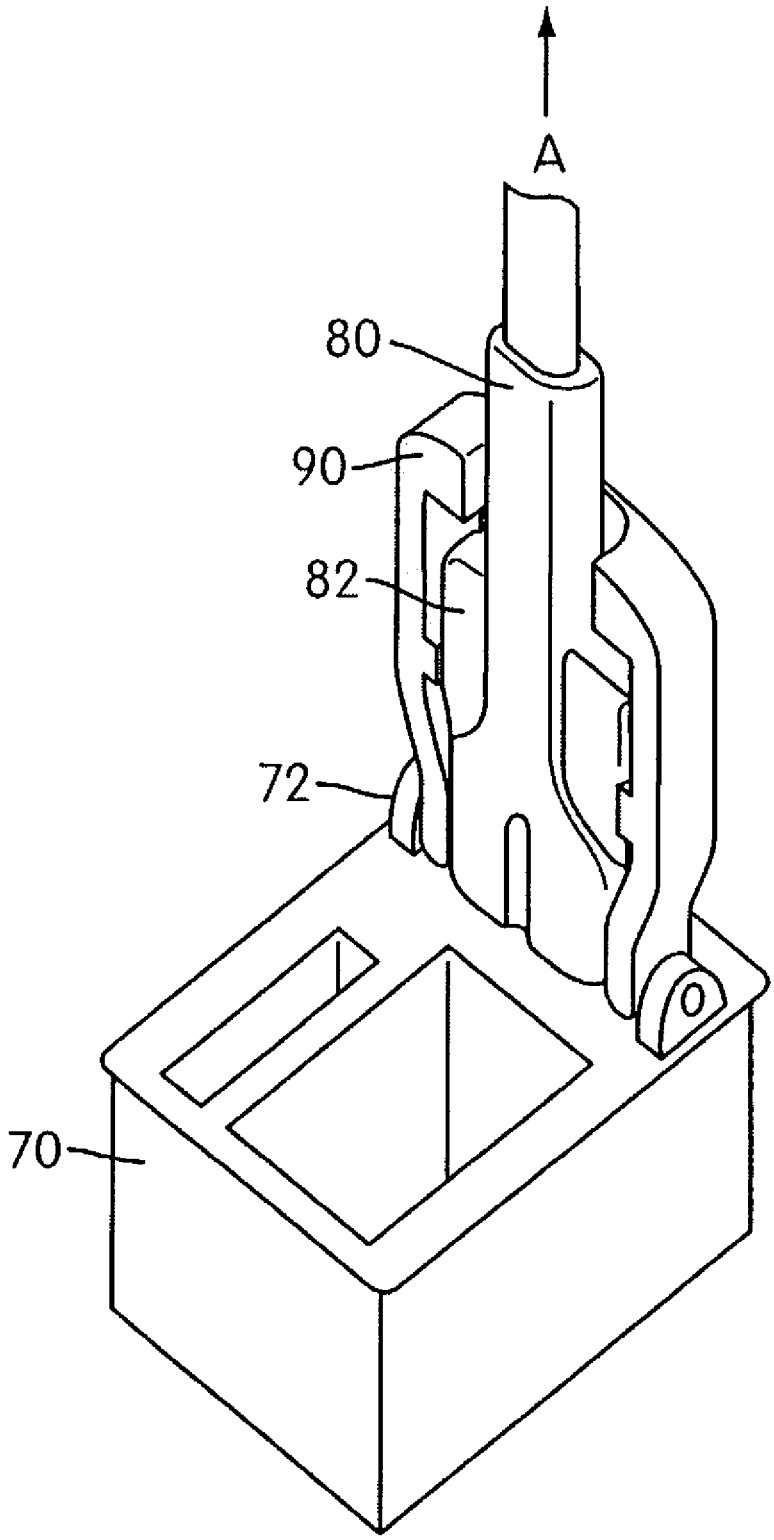
FIG. 18 shows a plug, retaining clip and cartridge assembly in accordance with an embodiment of the invention.

FIGS. 13(*a*) to 18 show an alternative form of the invention to that shown in FIGS. 7 to 12. Like reference numbers indicate like features.

A socket assembly fits into a medical apparatus in a casing hole in a 2.5 mm thick sheet metal panel that measures 40 mm×27 mm with a corner radius of 1.6 mm. The socket can withstand a pull out force of 330 Newtons. The assembly includes a double pole single throw switch, an IEC 320 main connection and a Special DC socket. The main and DC plugs are retained in the socket by the use of retaining clips. The retaining clips release from the plugs and the plugs disconnect from the sockets when a release force on the cable of 100+ Newtons is applied. The plug, socket and switch assembly comply with IEC 320 Standards.

The socket can be made, for example, from Nylon 66 with glass reinforcement. Four snaps and four clip retaining loops can withstand the release force, four being an example. The length of the four snaps can be adjusted to ensure a good fit. The profile and shape of the DC plug and socket are designed such that the IEC 320 plug cannot be fitted into the DC socket and that the DC connections are polarized. The DC contacts cannot be accessed by the use (or the standard test finger) because the DC contacts are deeply recessed.

The molded-on IEC 320 plug is identical to a standard IEC 320 plug with the exception that it has additional grip lugs. These lugs have two purposes. In conjunction with the raised identifying logo and part number, they are helpful for gripping the plug for insertion and removal of the plug. They are also used to engage and actuate the plug retaining device.

Figure 19:
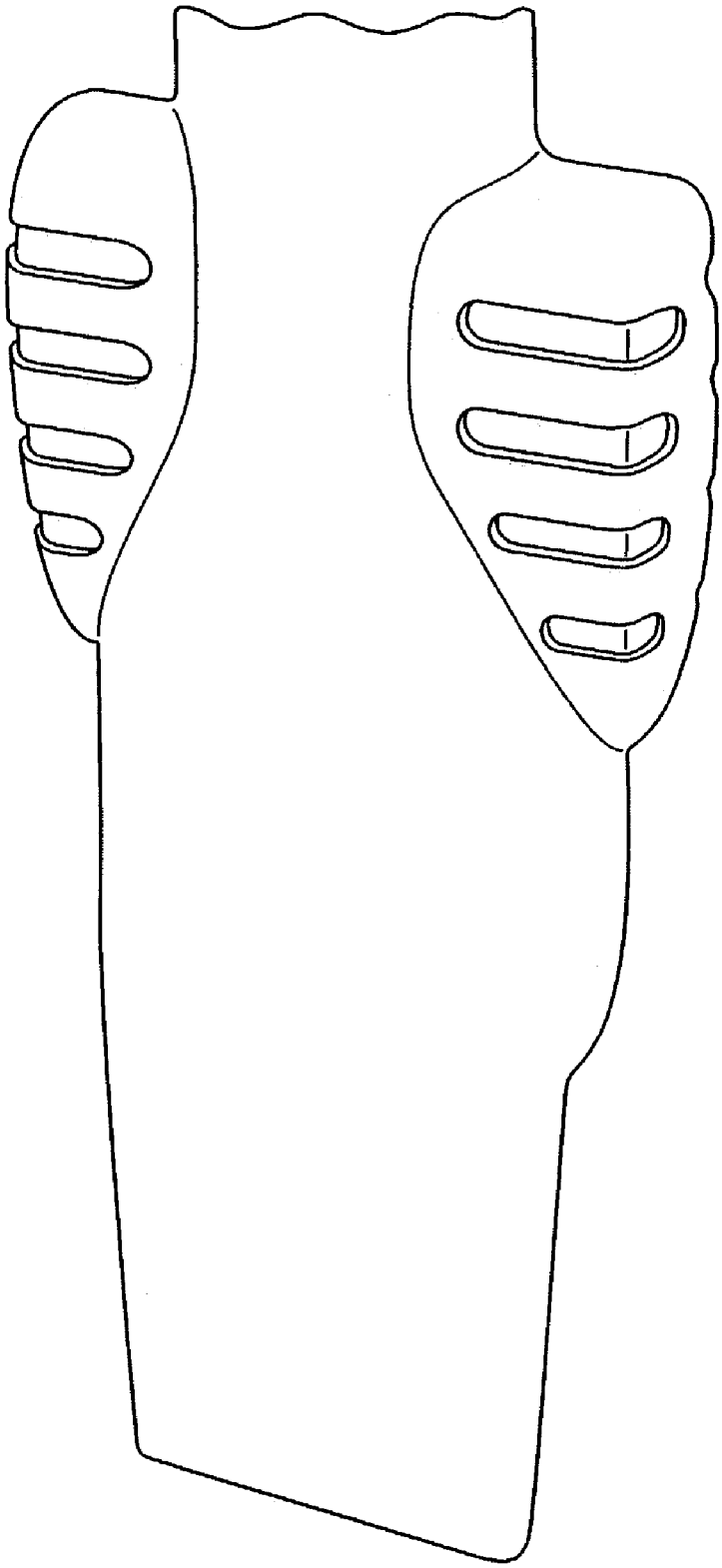
FIG. 19 shows a plug connected to a retaining clip and socket in accordance with an embodiment of the present invention.
Figure 20:
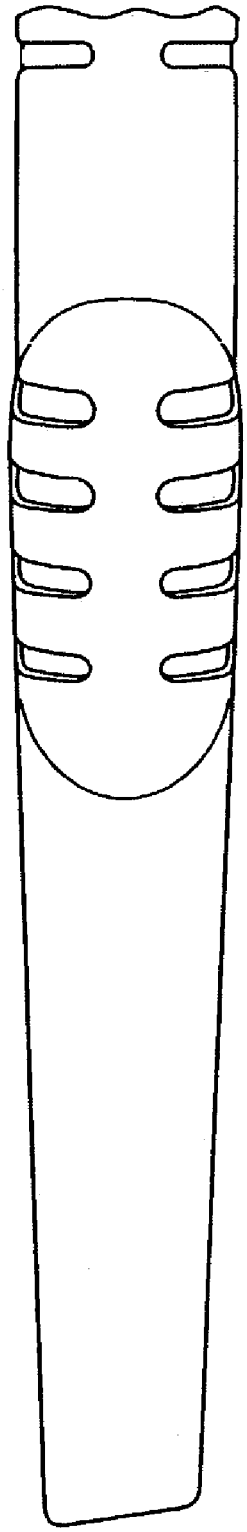
FIG. 20 shows a further view of a plug as shown in FIG. 19.
Figure 21:
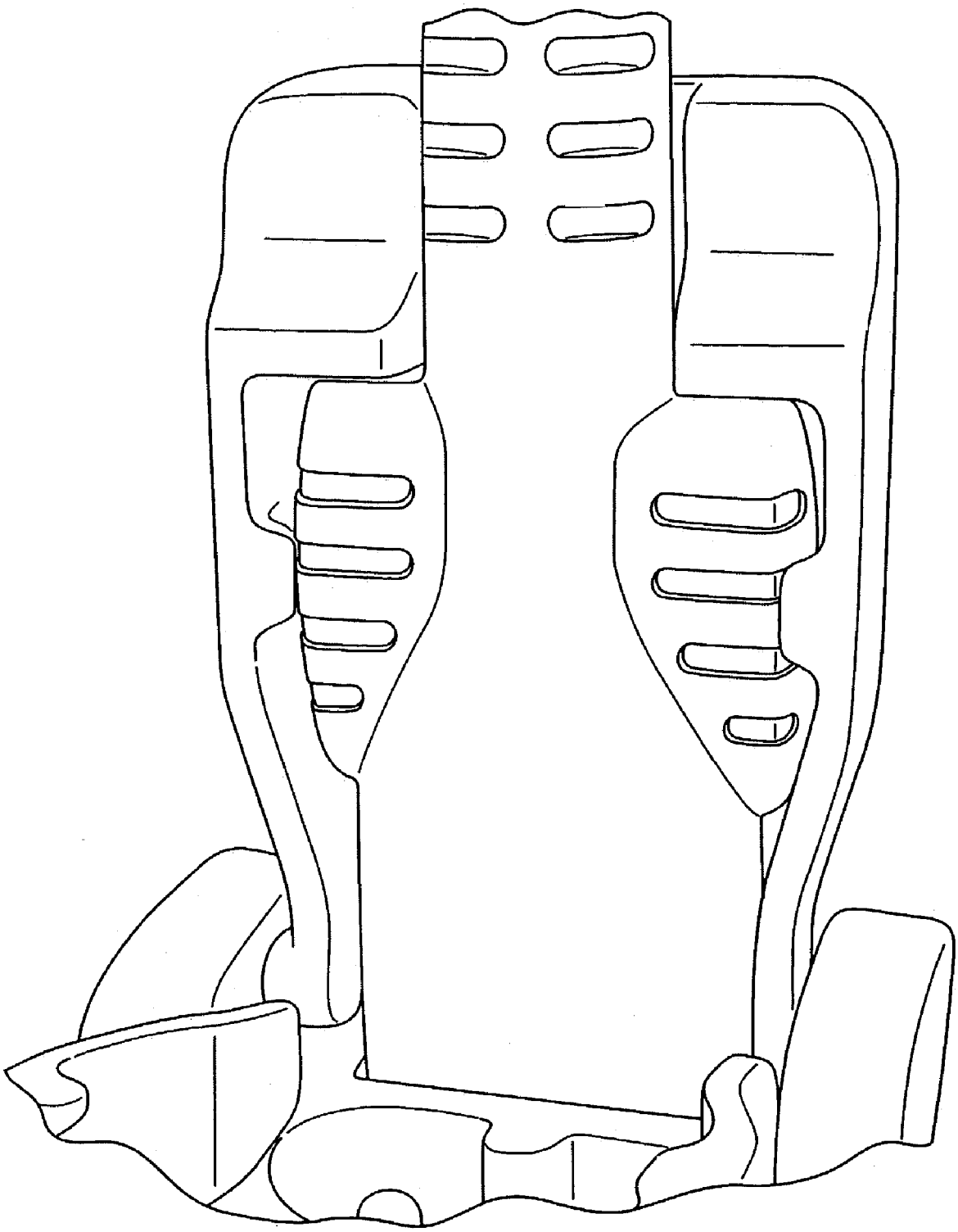
FIG. 21 shows a further view of a plug as shown in FIG. 19, sockets and retainer clips in accordance with an embodiment of the present invention.
Figure 22:
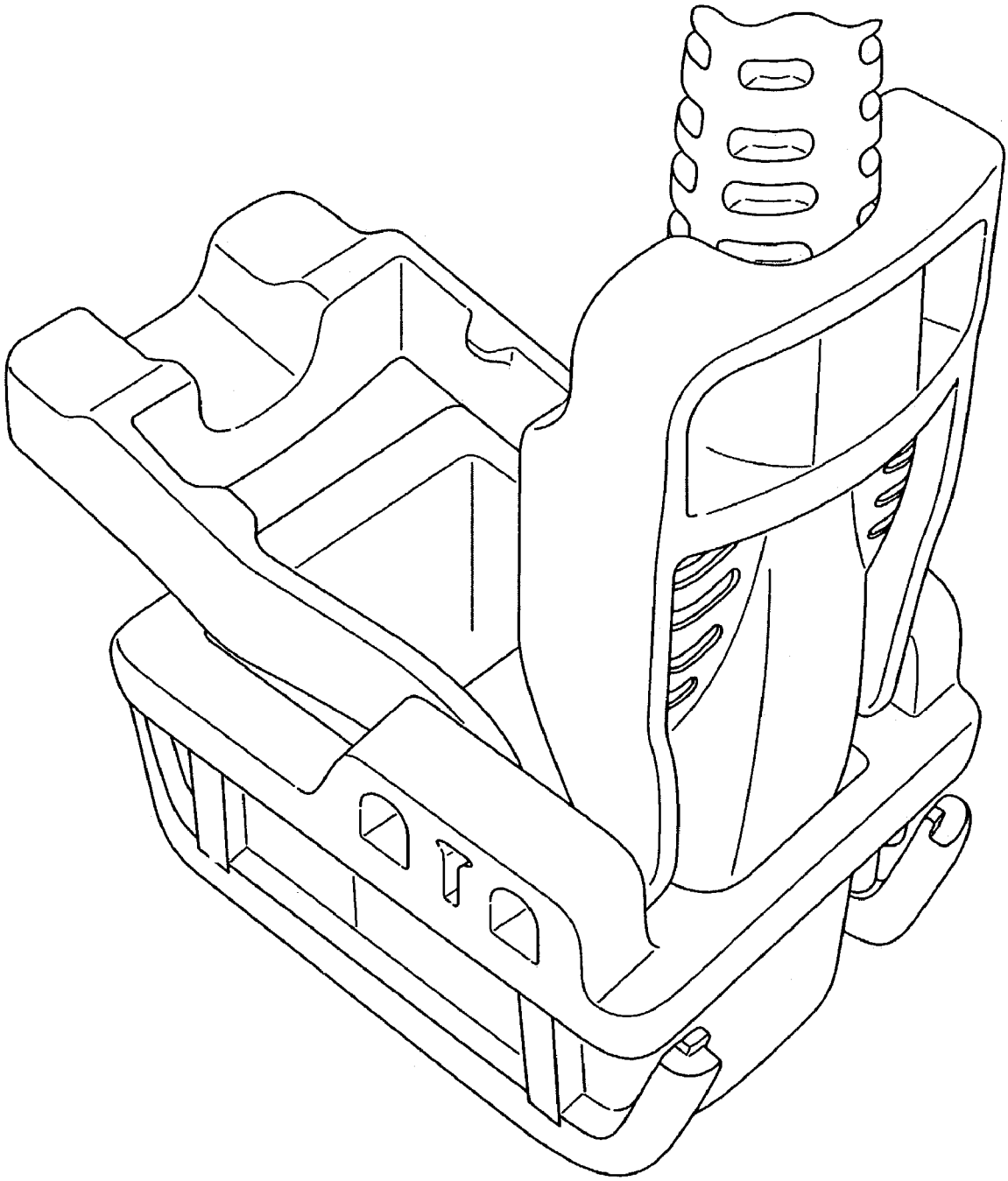
FIG. 22 shows a further view of the plug, sockets and retaining clips as shown in FIG. 19.
Figure 23:
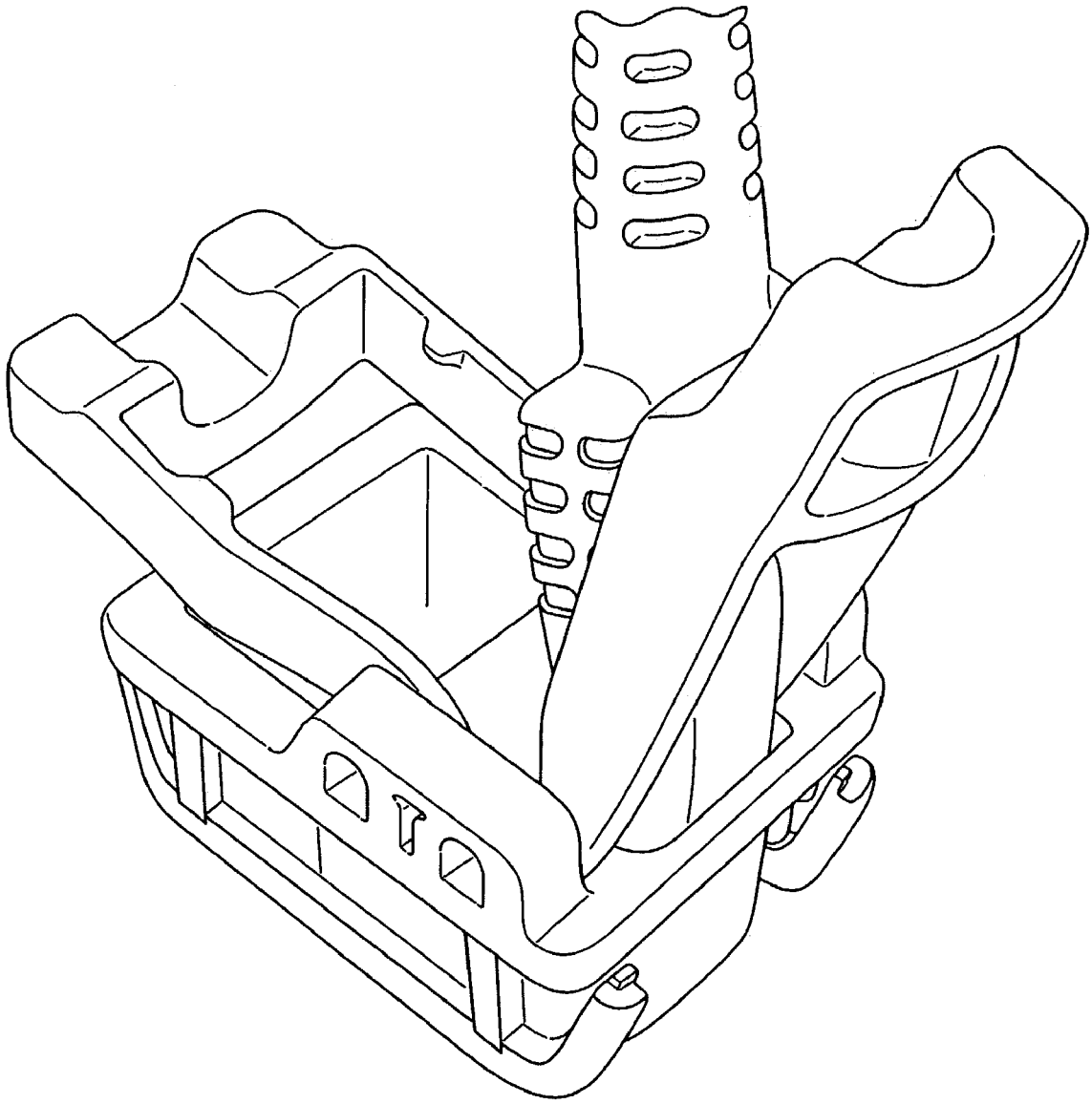
FIG. 23 shows a further view of the plug, sockets and retaining clip as shown in FIG. 22.
Figure 24:
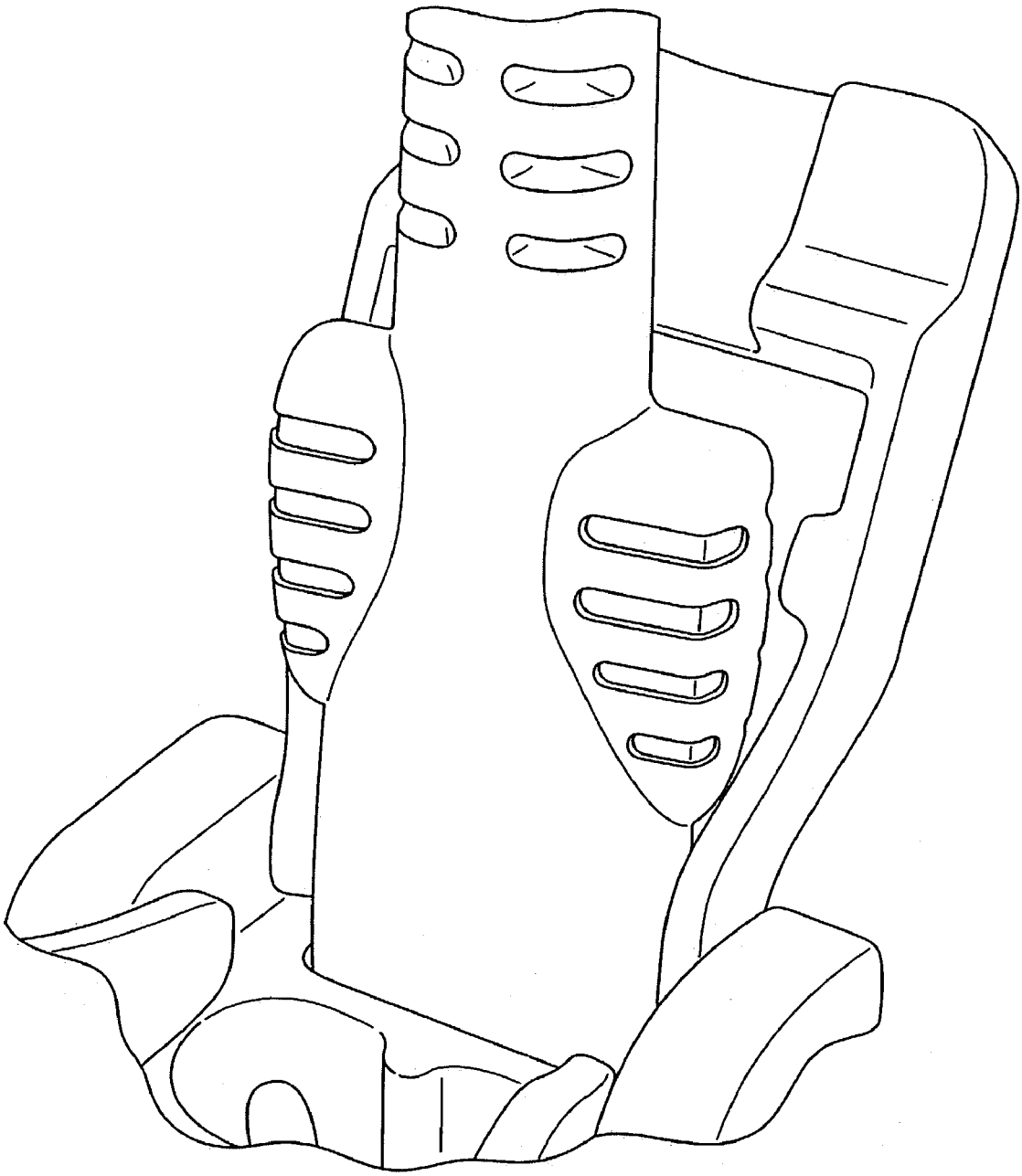
FIG. 24 shows a further view of the plug, sockets and retaining clips shown in FIG. 22.
Figure 25:
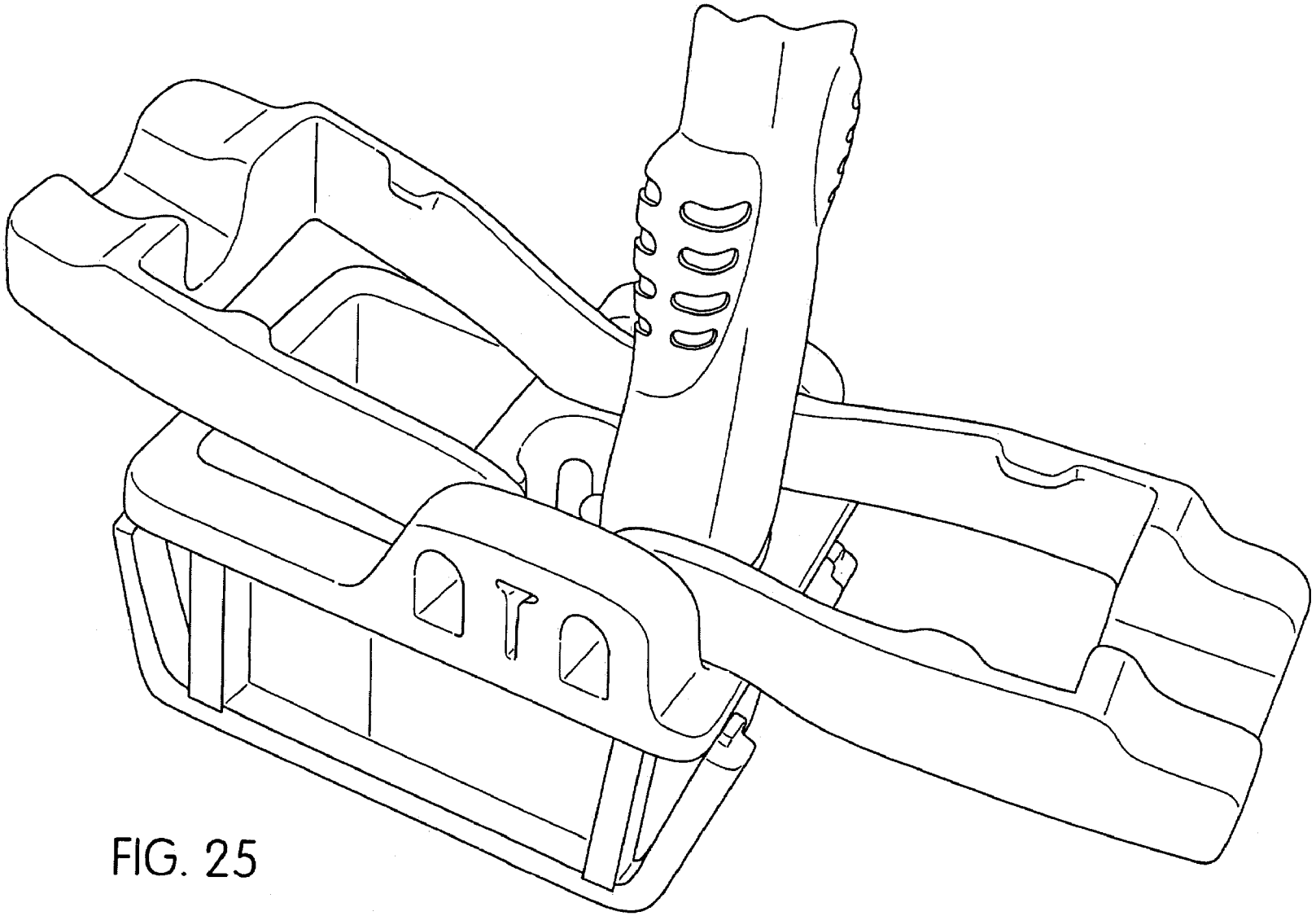
FIG. 25 shows a further view of the plug, sockets and retaining clips shown in FIG. 22.
Figure 26:
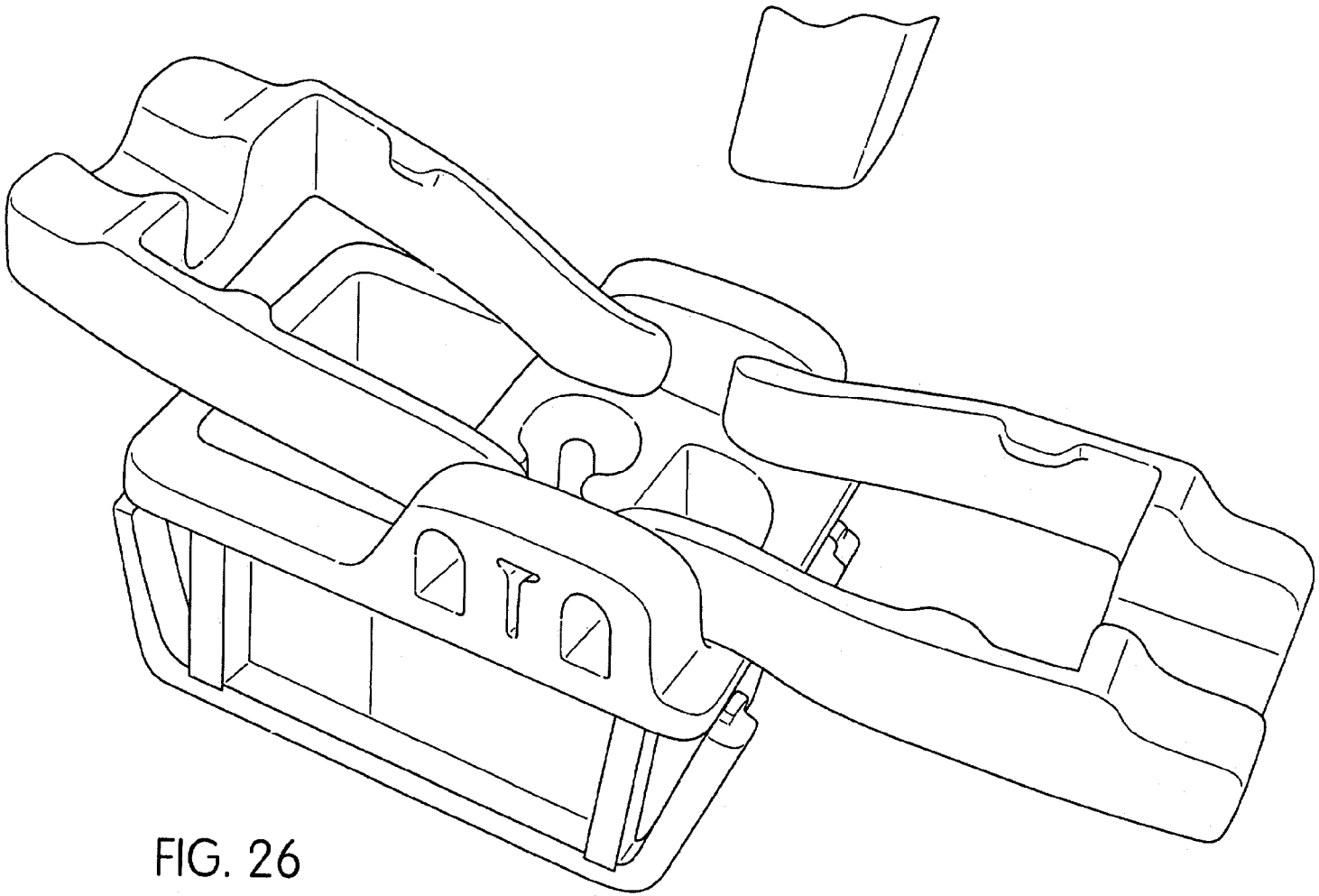
FIG. 26 shows a further view of the plug, sockets and retaining clips shown in FIG. 22.
Figure 27:
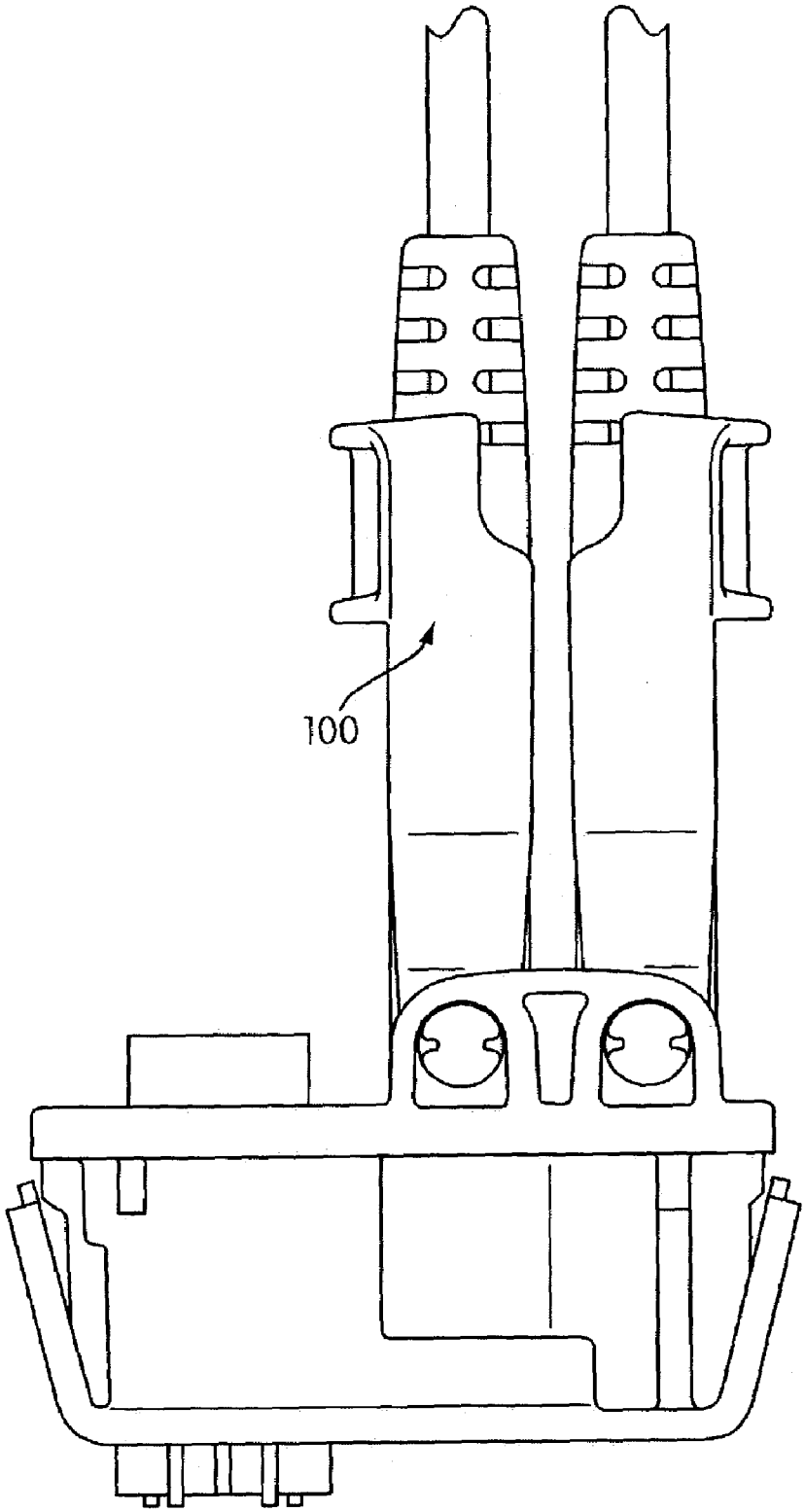
FIG. 27 shows a further view of the plug, sockets and retaining clips shown in FIG. 22.
Figure 28:
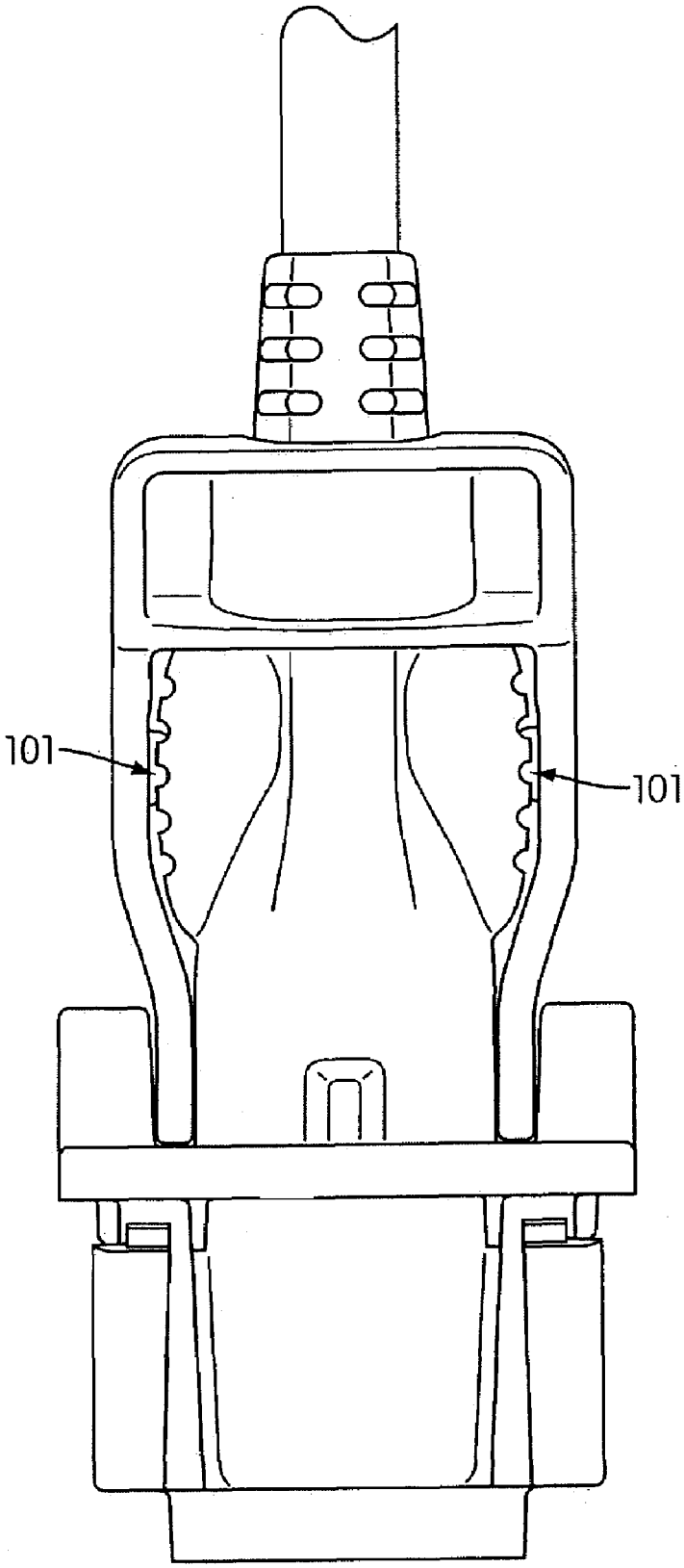
FIG. 28 shows a further view of the plug, sockets and retaining clips shown in FIG. 22.
Figure 29:
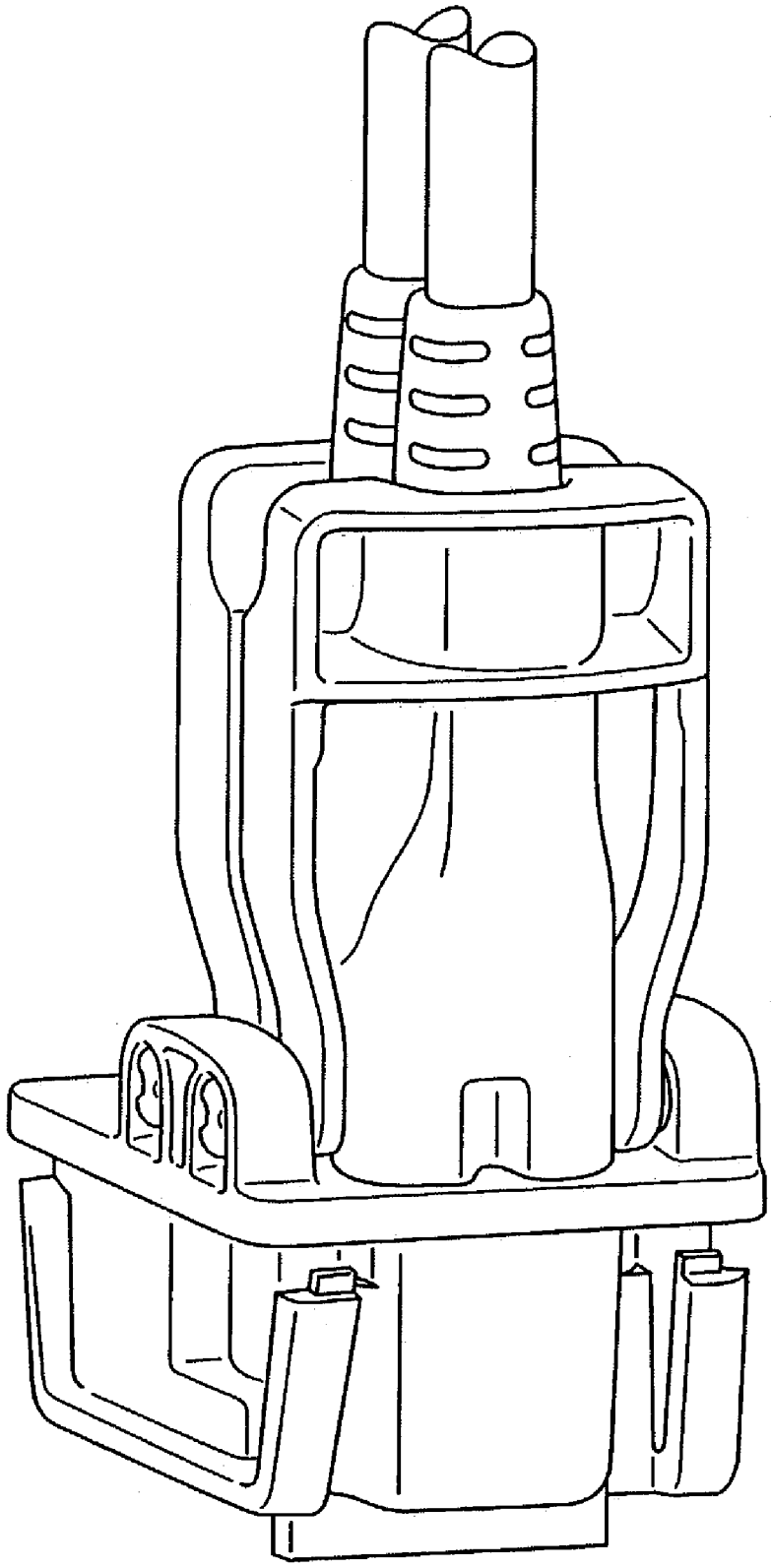
FIG. 29 shows a further view of the plug, sockets and retaining clips shown in FIG. 22.
Figure 30:
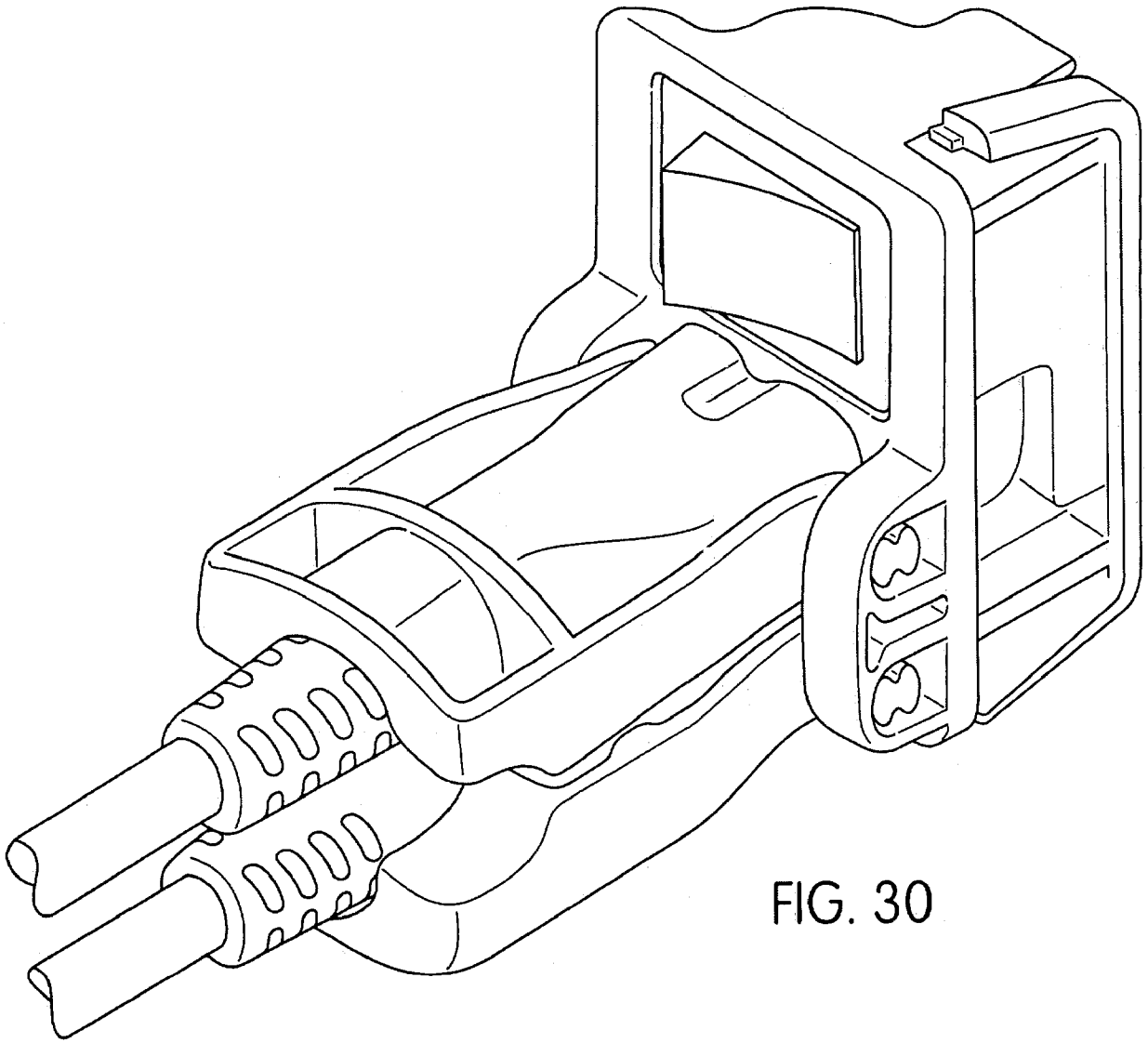
FIG. 30 shows a further view of the plug, sockets and retaining clips shown in FIG. 22.
Figure 31:
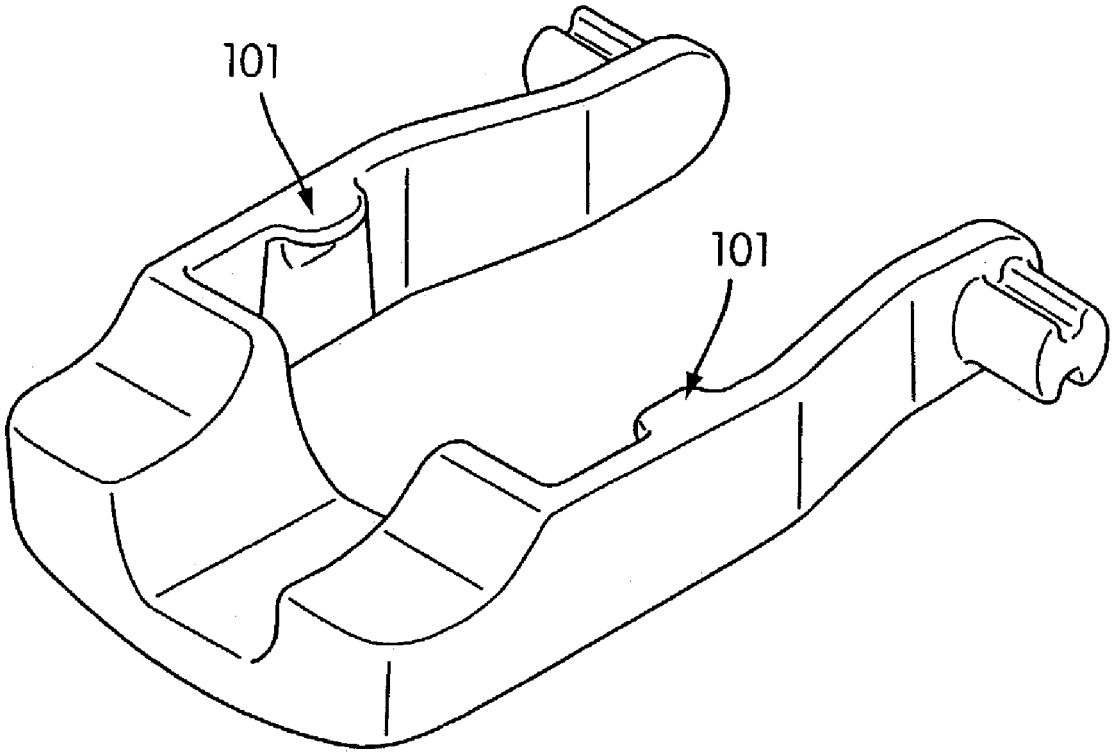
FIG. 31 shows a further view of the retaining clips (one only) shown in FIG. 22.

The shape of the molded-on special DC plug, seen in FIGS. 19 and 20, is based on a standard IEC 320 plug with the exception that it has a different profile. It is longer, and it has the additional grip lugs. The power requirements on this plug are 30 V DC at 2.5 amps, the connection is to be reliable for the number of insertions specified by the standard, and the contact resistance is not to exceed 10 mΩ. The plugs have a specific colour. The plug also has the identifying logo and part number as shown.

The plug retaining clip is seen in FIGS. 21, 22, 23, 24, 25, 26, 27, 28, 29, 30 and 31 and is prefereably formed as two retaining clips so as to retain the AC and the DC plugs. They are made from nylon, e.g., Nylon 66. To vary the required plug withdrawal force, the ramp angle 100 (see FIG. 27) and the retention lugs 101 (see FIGS. 28 & 31) can be adjusted. The thickness of the retention clip can be adjusted.

The terminations and wiring at the back of the socket, in this example, fit within flow generators "S6" and "S7", both manufactured by ResMed, Incorporated.

The embodiments of the present invention have been described by reference to electricity power cords, connectors and appliance inlets that are configured for the propagation of electromagnetic energy. However, it will be appreciated that the invention may be adapted to serve its intended function in other systems.

By way of example other systems may include other propagation systems that include optical fiber and terminals.

Additionally, the present invention may be adapted for use in ventilation medical apparatus.

In medical ventilator art (i.e., breathing apparatus), a gas conduit system may serve to connect a source of breathable gas to a patient interface or to connect a sensor port to a transducer for the detection of pressure or other system parameters.

In a breathing apparatus suitable for the delivery of non-invasive positive pressure ventilation or nasal continuous positive pressure treatment the requisite components would be the flow generator having an outlet for the supply of breathable gas, the gas conduit in which the breathable gas moves from the flow generator and a patient interface such as a mask connected to the gas conduit for delivery of the breathable gas to the user. In breathing apparatus there may also be included within the breathing circuit other components such as humidifiers or in-line filters. Humidifiers are used in breathing apparatus to supplement the humidity in the breathable gas being delivered to a user. Typically the humidifier is placed in the breathing circuit between the source of breathable gas and the patient interface.. Examples of in-line humidifiers are depicted in U.S. Pat. No. 6,338,473 and U.S. Design Pat. No. 419658. An example of an in-line humidifier integrated with the flow generator is depicted in PCT Patent Application No. PCT/AU02/00155 and PCT Patent Application No. PCT/AU02/00156. Alternatively the humidifier may be located other than in-line between the flow generator and the patient interface as depicted in U.S. patent application Ser. No. 09/099665. The content of each cited document is incorporated in its entirety by reference.

Typically, in breathing circuits all major component blocks such as flow generator, in-line filter, humidifier and patient interface are fluidly connected by lengths of gas conduit with each component connected to the respective lengths of gas conduit by way of rubber friction fit collars.

An advantage of using the present invention in a breathing circuit is that should the circuit be subjected to a release force then the retaining device will release so as to allow the part of the circuit subjected to the release force to disengage from the rest of the breathing circuit at an intended point. The intended point will typically be determined to lie between two components that are connected to each other by using suitable connectors and the retaining clip. The present invention allows the breathing circuit to be configured so as to minimize damage to the components of the system such as the flow generator, humidifier or patient interface. Furthermore, the present invention can reduce the opportunity for the user or other people to sustain injury. For example should a pull force in excess of the release force be applied to the gas conduit and cause disconnection of the gas conduit from the humidifier, then the pull force will not lead to the humidifier being unseated from its operating position and cause injury or damage by falling onto the user or the floor.

Similarly the flow generator may be prevented from being unseated from its operating position and causing injury or damage. By preventing the pull force being totally applied to the patient interface because the retaining clip yields upon being exposed to the release force, the invention spares the user wearing the patient interface from experiencing discomfort or injury by the interface and holding straps being pulled in the direction of the pull force. Similarly the breathing apparatus may be protected from contamination by the retaining clip releasing before an in-line filter is dislodged in response to a pull force.

An advantage of using the present invention is that should the breathing circuit be subjected to a pull force of a magnitude that is as least as large as the release force then the retaining device will yield so as to allow the part of the circuit subjected to the release force to disengage from the rest of the circuit at the intended location. The point of disengagement will be at a location that lies between the component subjected to the pull force and the next component down stream from the source of the pull force to which it is connected via the retaining device.

By using a graded release force system the circuit can be configured so as to allow for "an elegant system disintegration". An elegant system disintegration means the controlled disassembly of components. For example, when a pull force is exerted to a circuit, the connection which is designed to release at the lowest force will be the first connection to surrender to the pull force thereby causing the component or components closest to the source of the pull force (i.e. those components upstream of the relevant release device) to be disconnected from the remaining components. In this way remaining components are disconnected from the disruptive pull force.

Where the interconnectable breathing circuit components can be scaled in a hierarchy of importance, the use of graded release force connections may be adopted with particular benefit to system integrity. For example it would be advantageous from a safety perspective for the release force characteristic of a connection between the humidifier and the gas conduit interconnecting with patient interface to have a release force that is lower than the release force applicable to the connections for the gas conduit inter connecting the humidifier to an in-line filter and the force required to move the flow generator. This configuration would operate such that if a pull force was applied to the gas conduit which interconnects the humidifier to the patient interface the connection between the gas conduit and the humidifier would surrender to the pull force and thereby prevent a humidifier from being pulled towards the user. Preferably the force required to move the humidifier would be greater than the release force to further reduce the opportunity for the humidifier to move. The force required to move the humidifier might be determined through adoption of a retention system such as clips to retain the humidifier in its intended position or even a base or rubber feet which tend to cause a frictional grip between the humidifier and the surface upon which it sits.

Furthermore if the circuit includes an in-line filter intended to protect the flow generator from contamination sourced from the user interface end of the breathing circuit then the preferred placement of the connection having the lowest release force would be at a location that is closer to the user interface than the location of the connection or connections linking the gas path between the in-line filter and the flow generator. By operation of the release device, should the relevant connection be subjected to a magnitude of pull force that is at least as great as the relevant release then the system contamination prevention system remains intact.

When determining the maximum release force for the connection or connections between the flow generator and the in-line filter, a decision may be made to set it at a level that is equal to or greater than the move force for the flow generator. When making that decision a determination may be made as to the preferable consequence of a pull force. Consideration is given as to whether it is preferable to the system's integrity for the connections between the in-line filter and flow generator to yield to the pull force before the flow generator moves or visa versa. Either configuration may achieved through adoption of the present invention.

A further feature of the invention is that the retaining clip and plug pair may be color coded, the color representing the characteristics of the pair. For example, the characteristic maybe a release force of a given magnitude. When the matched plug is used with the corresponding clip, the desired predetermined release force will characterize the combination.

In addition to color coding, other guide mouldings such as tongue and groove effects may be incorporated into the retaining clip and plug so as to allow for the matching of correct pairs and prevent the attachment of unmatched pairs. Such use of pairing retaining clips with plugs may also serve in a multi plug socket system to prevent the unintentional mismatching of plugs to sockets, for example where two plugs of the same configuration with respect to their pins and the respective sockets are to be used in close proximity. The adoption of a colored retaining clip and a similarly colored plug will serve to provide a visual indication of the correct pairing of the plug with the socket to which the retaining clip relates. The second socket would have attached a retaining clip of different color, that color being used to identify a similarly colored plug intended for connection to the designated socket.

The placement of a logo across a retaining clip and plug combination can serve as a visual guide to correct assembly of the components.

Based on the above, it can be seen that the inventors have effectively developed a model by which the force required to remove the plug system can be accurately predicted. In this instance, "force" is intended to mean the withdrawal force necessary to withdrawal the plug from the socket and/or the release force required to cause the clip to become disengaged with the plug. In general practice, the release force is designed to be greater than the withdrawal force. Thus, the predicting model, in one embodiment, focuses on the release force, rather than the withdrawal force. However, the predicting model could also be used to predict the withdrawal force alone, for example, in the event there is no clip or simply to ensure that the release force will be greater than the withdrawal force.

Stated differently, the inventors, by manipulating the various parameters defined above can design a plug system and predict whether the as-designed plug system should be able to meet the standard range of release/withdrawal forces, e.g., 100 to 300 Newtons, for any given application.

Figure 32:
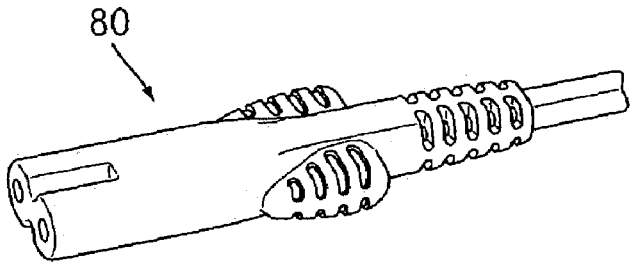
FIG. 32 is a perspective view of a plug according to one embodiment of the present invention.
Figure 33:
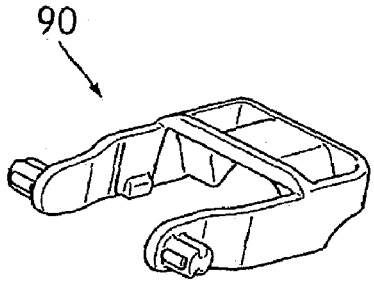
FIG. 33 is a perspective view of a clip according to one embodiment of the present invention.

There are several considerations the inventors have identified when designing the plug/clip to achieve the desired release force. For the plug 80 and clip 90 shown in FIGS. 32 and 33, these include tab width, material stiffness and ramp angle, for example. While the preferred model which is described below is based on elastic/plastic analysis to provide an analytical solution, the modeling technique is not limited to such. For example, the model could be formulated using finite element analysis (FEA).

Figure 34:
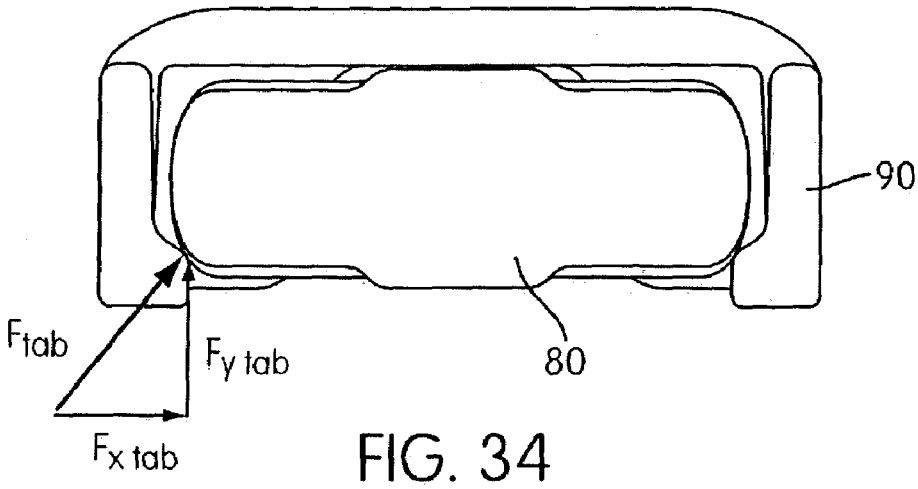
FIG. 34 illustrates the plug and clip in connected condition and includes a force diagram.

Tab width may be varied to achieve the desired release force. Preferably, the plug 80 is secured by the clip through a pair of overbite tabs at either side of the arm. See FIG. 34. To release the plug, the arms at both ends of the clip have to deflect at an amount, D. Plug will hence experience a force, Ftab, at the contact. Applying simple beam deflection:

$$D=Fxtab\cdot L^3/3\cdot E\cdot I$$

where

D=deflection required to release the plug

Fxtab=Force required to deflect the beam

L=Length of Arm

E=Young's Modulus of material, and

I=moment of inertia.

Assuming that D, L & E remain constant, an increase in the moment of inertia, I, will increase the force, Fxtab, required to release the plug. An increase in the tab width, in this case, will increase I, and thus increase Fxtab.

For a rectangular section, $I=\text{width}\cdot\text{height}^{3/}12$.

This means that increasing the width will linearly increase the force required to release the plug.

Material stiffness may also be varied. Stiffness of the material will depend on the amount of glass content. From "Modem Plastics Handbook" by Charles A. Harper, Appendix C.20, different amount of glass fibres were put into Nylon 66.

TABLE 1

| X axis - Glass Content (%) | Y axis - Flexural Strength (psi) |
|---|---|
| 15 | 480 |
| 31.5 (average) | 800 |
| 50 | 1460 |

Samples were conditioned to equilibrium with 50% relative humidity.

Figure 35:
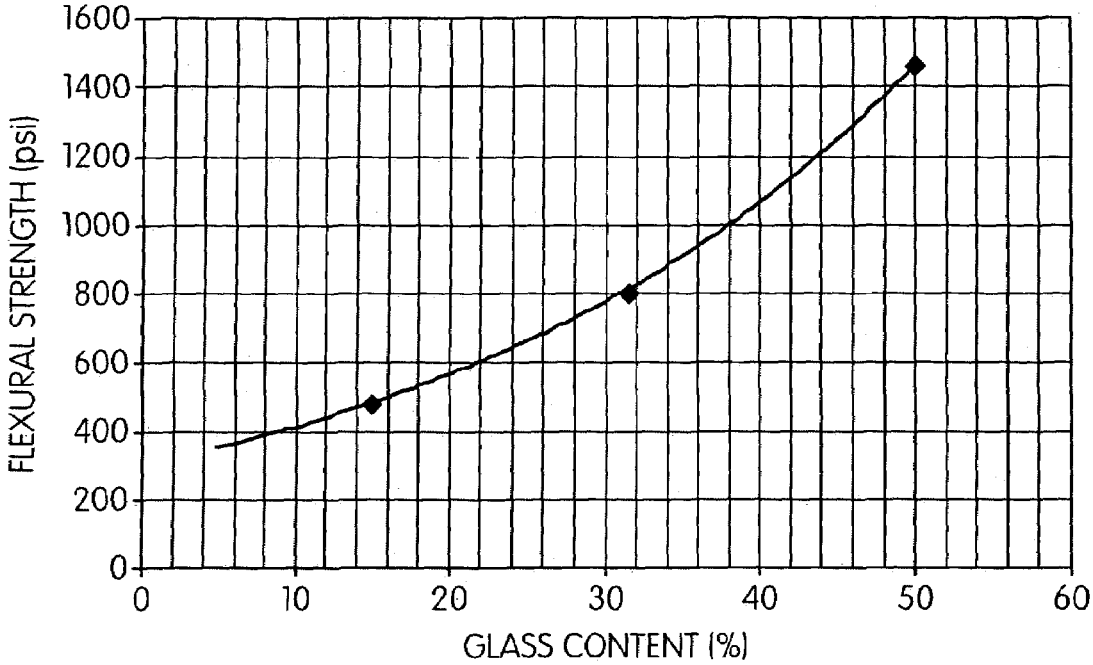
FIG. 35 is a graph plotting flex and stiffness v. glass content.

The relationship between the amount of glass fibres content and flexural stiffness is plotted in FIG. 35. The plot is then extrapolated exponentially to estimate the properties at lower glass content.

Figure 36:
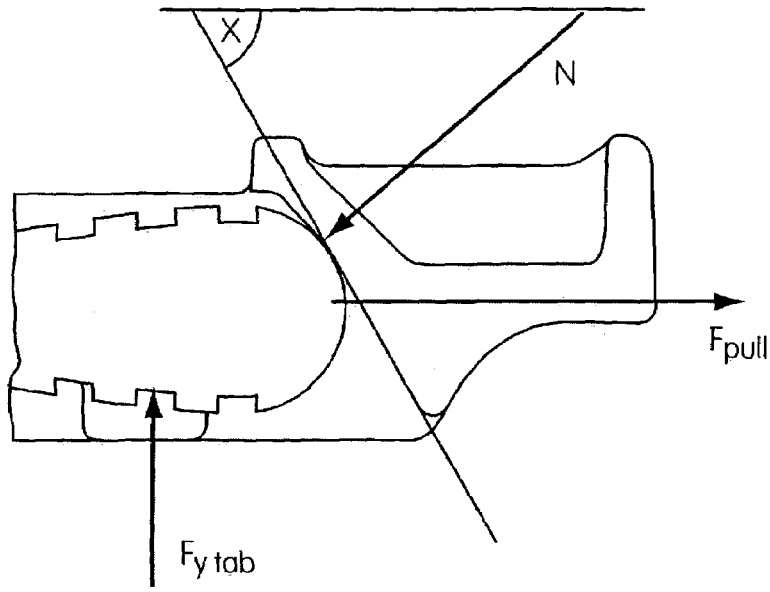
FIG. 36 is a force diagram of the forces encountered by the plug.

Ramp angle may be varied to affect release. The amount of ramp will determine how hard the plug has to be pulled to achieve enough force vertically to release the clip from the tabs. See FIG. 36, where N=contact force between the clip and the plug at a selected ramped angle, $F_{y\ tab}$=force experienced by the plug through the clip tab (this is assumed to be more or less vertical) and $F_{pull}$=force required to pull the plug away from the cord clip.

Figure 37:
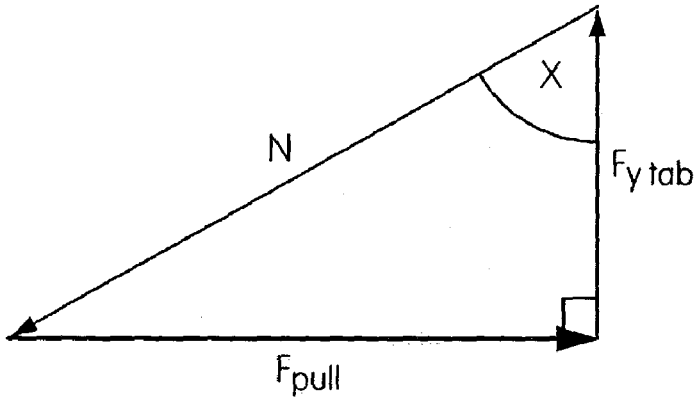
FIG. 37 is a force body diagram of the forces illustrated in FIG. 36.

Assembling those forces into the free-body-diagram in FIG. 37, and given that the sum of all these forces=0, and that $F_{ytab}/F_{pull}$=Tan X, where X=angle in degrees, then $$F_{pull}=F_{ytab}/\text{Tan } X \quad \text{(B)}$$

where $F_{ytab}$ is constant (no change to Tab or material).

To test the accuracy of the release force prediction model, a minimum release force Fpull≧100N was selected. A first attempt is done to give a rough idea of the release force values. Using the following values for the following parameters, the relationship described in equation (B) is plotted out, thus giving us a range of possible force values at different ramp angles.

Parameters:

Tab width in contact=1.7 mm

X=45 Degrees, Material=Nylon66 with 10% glass

Result Obtained: Fpull=31.7N (mean).

Figure 38:
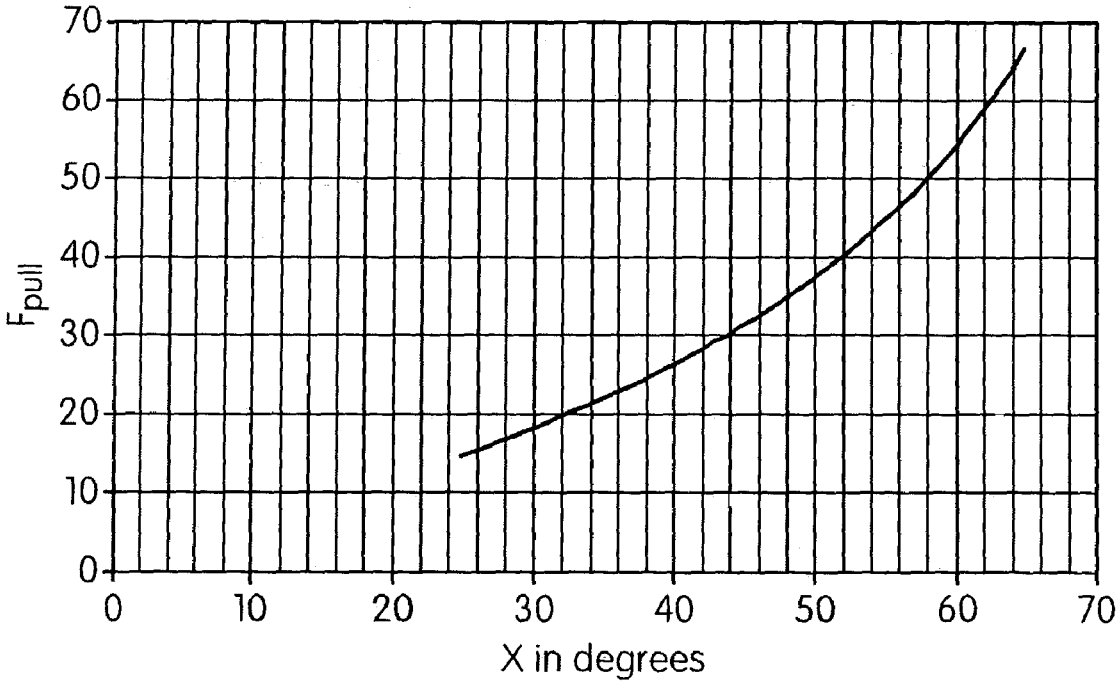
FIG. 38 is a graph plotting pull force v. ramp angle.

FIG. 38 was obtained by plugging the above values into equation (B). From this result, it is seen that the predicted release force is too low. Based on the model, one or more of the three exemplary parameters will need to be changed to result in a plug system with a minimum release force of at least 100N.

In a second attempt, the ramp angle was changed from 45 degrees to 60 degrees, i.e., X=60 degrees (up from 45 degrees), and this value was plugged into equation (B) to obtain the predicted release force. From FIG. 38, this prediction would be ~54N, provided the same tab width and glass content. Of course, this force is too low, so other parameters were changed, namely: tab width=2.2 mm (up from 1.7 mm)—a 29.5% length increase and the glass content=15% (up from 10%)—this is an increase from 400 to 480 psi, a 20% increase. Taking all these changes in account, the predicted release force=54·1.295·1.2=83.9N. Adding the socket terminal pull force of 45.35N, we would expect a predicted release force of 129.25N.

The actual pull off force obtained, together with the force contributed by the socket terminals, was 143.75N. Therefore, compared to the predicted values of 129.25N, this is 14.5N, or an 11% difference. The possible cause of deviation can be explained as follows. With the increase in tab width, the plug is actually experiencing more stiffness of the clip arms, making the arms harder to deflect. This is because the tab widths were increased towards a stiffer geometry part of the clip. This provides a more complex deflection mechanism of the arm other than just a simple beam deflection. However, this can be taken into account by simply changing the beam deflection model to a more comprehensive model taking the latter considerations into account.

Although the invention has been herein shown and described in what is conceived to the most practical and preferred embodiment, it is recognized that departures can be made within the spirit and scope of the invention, which is not to be limited to the details described herein.

What is claimed is:

1. A plug retaining assembly comprising:

a plug including a lug;

a socket to interface with the plug; and a retaining clip including a lug engaging mechanism structured to allow disengagement of the plug from the socket at a predetermined release force applied to the plug while the retaining clip is engaged with the plug, the retaining clip being movably positioned with respect to the socket for movement between (1) a non-plug-retaining position, and (2) a plug-retaining position wherein a sloping surface of the lug engaging mechanism engages the lug, the sloping surface having an angle that is at least partially determinative of the predetermined release force, wherein the retaining clip is movable between the non-plug-retaining position and the plug-retaining position while the plug is engaged with the socket.

2. The plug retaining assembly of claim 1, wherein the plug is configured to disconnect from the socket at a predetermined release force and wherein the plug retaining assembly is reconfigurable so that after the plug has disconnected due to being subjected to at least the release force, the plug may be reconnected to the socket and remain connected to the socket until again subjected to the release force.

3. The plug retaining assembly of claim 1, wherein, in use, the plug is disconnectable from the socket by application of a withdrawal force that is substantially less than the release force required to disconnect the plug from the socket when the retaining clip is used.

4. The plug retaining assembly of claim 1, wherein the plug includes at least one pin receiving slot that is adapted to receive respective pins provided on the socket.

5. The plug retaining assembly of claim 1, wherein the plug includes a pair of lugs.

6. The plug retaining assembly of claim 5, wherein the retaining clip includes a pair of tabs positioned at respective ends of a pair of arms, the tabs adapted to engage with respective lugs of the plug to maintain the retaining clip in the plug retaining position.

7. The plug retaining assembly of claim 6, wherein the resilience of the arms is at least partially determinative of the predetermined release force.

8. The plug retaining assembly of claim 6, wherein the friction between the lugs and the tabs is at least partially determinative of the predetermined release force.

9. The plug retaining assembly of claim 1, wherein the retaining clip includes a groove adapted to receive an upper portion of the plug when the retaining clip is in the plug retaining position.

10. The plug retaining assembly of claim 1, wherein the predetermined release force is between about 100–300N.

11. The plug retaining assembly of claim 1, further comprising a second plug, a second socket, and a second retaining clip, wherein the retaining clip and second retaining clip are rotatable in opposite directions.

12. The plug retaining assembly of claim 1, wherein the retaining clip includes a pair of arms and a bridge piece that interconnects the pair of arms, the bridge piece providing the sloping surface.

13. The plug retaining assembly of claim 12, wherein a resilience of the pair of arms is at least partially determinative of the predetermined release force.

14. The plug retaining assembly of claim 1, wherein the sloping surface has a substantially planar configuration.

15. The plug retaining assembly of claim 1, wherein the sloping surface is adapted to disengage from the lug at the predetermined release force.

16. A method of changing the release force of a plug retaining assembly, the method comprising:

providing the plug retaining assembly with a plug, a socket to interface with the plug, and a retaining clip, wherein the plug includes a lug and the retaining clip includes a lug engaging mechanism having a wedge angle adapted to allow disengagement of the plug from the socket at a predetermined release force while the retaining clip is engaged with the plug; and selecting the wedge angle in accordance with the predetermined release force;

engaging the plug with the socket; and moving the lug engaging mechanism with respect to the engaged plug and socket to position the wedge angle with respect to the lug.

17. The method of claim 16, further comprising configuring the plug retaining assembly to allow the plug to disconnect from the socket at a predetermined release force and to include the ability to reconfigure the plug retaining assembly so that after the plug has disconnected due to being subjected to at least the release force, the plug may be reconnected to the socket and remain connected to the socket until again subjected to the release force.

18. The method of claim 16, further comprising configuring the plug retaining assembly to include the ability for a user to disconnect the plug from the socket by application of a withdrawal force that is substantially less than the release force required to disconnect the plug from the socket when the retaining clip is used.

19. The method of claim 16, wherein the moving comprises pivotally moving the retaining clip from a non-plug-retaining position to a plug-retaining position to position the wedge angle with respect to the lug.

20. The method of claim 16, wherein the predetermined release force is between about 100–300N.

21. The method of claim 16, wherein the lug engaging mechanism includes a substantially planar surface oriented at the wedge angle so as to allow disengagement of the plug from the socket at the predetermined release force.

22. The method of claim 16, wherein the wedge angle is adapted to allow disengagement of the lug engaging mechanism from the lug at the predetermined release force.

23. A method of setting a release force of a plug retaining assembly, the method comprising:

providing the retaining assembly with a plug, a socket to interface with the plug, and a retaining clip, wherein the plug includes a lug and the retaining clip includes a lug engaging mechanism having a wedge angle adapted to allow disengagement of the plug from the socket at a predetermined release force while the retaining clip is engaged with the plug;

selecting a resilience of the retaining clip in accordance with the predetermined release force;

engaging the plug with the socket; and moving the lug engaging mechanism with respect to the engaged plug and socket to position the wedge angle with respect to the lug.

24. The method of claim 23, further comprising configuring the plug retaining assembly to allow the plug to disconnect from the socket at a predetermined release force and to include the ability to reconfigure the plug retaining assembly so that after the plug has disconnected due to being subjected to at least the release force, the plug may be reconnected to the socket and retain connected to the socket until again subjected to the release force.

25. The method of claim 23, further comprising configuring the plug retaining assembly to include the ability for a user to disconnect the plug from the socket by application of a withdrawal force that is substantially less than the release force required to disconnect the plug from the socket when the retaining clip is used.

26. The method of claim 23, wherein the moving comprises pivotally moving the retaining clip from a non-plug-retaining position to a plug-retaining position to position the wedge angle with respect to the lug.

27. The method of claim 23, wherein selecting the resilience of the retaining clip includes selecting a resilience of arms of the retaining clip.

28. The method of claim 23, wherein the predetermined release force is between about 100–300 N.

29. The method of claim 23, wherein the lug engaging mechanism includes a substantially planar surface oriented at the wedge angle so as to allow disengagement of the plug from the socket at the predetermined release force.

30. The method of claim 23, wherein the wedge angle is adapted to allow disengagement of the lug engaging mechanism from the lug at the predetermined release force.

31. A plug retaining assembly, comprising:

a plug having a first end and a second end opposite the first end, the second end including a lug;

a socket having a receptacle to receive the first end of the plug, the second end of the plug including the lug being exposed when the plug is engaged with the socket; and a retainer having a first end and a second end, the first end being pivotably mounted on the socket, and the second end being engaged with the lug such that the lug is positioned between the retainer and the socket, wherein the second end of the retainer includes a lug engaging mechanism structured to allow disengagement of the plug from the socket at a predetermined release force applied to the plug while the retainer is engaged with the plug.

32. The plug retaining assembly of claim 31, wherein the retainer includes a pair of pins that insertable within respective bores provided in lugs of the socket to enable pivotal movement of the retainer about the pins.

33. The plug retaining assembly of claim 32, wherein at least one of the bores includes a notch and at least one of the pins includes a protrusion, the protrusion adapted to engage within the notch when the retainer reaches a plug retaining position.

34. The plug retaining assembly of claim 31, wherein the first end of the retainer is rotatable about an axis adapted to intersect a longitudinal axis of the plug in use.

* * * * *